US010168060B2

(12) United States Patent
Tanaka et al.

(10) Patent No.: US 10,168,060 B2
(45) Date of Patent: Jan. 1, 2019

(54) AIR-CONDITIONING APPARATUS

(71) Applicants: Kosuke Tanaka, Tokyo (JP); Hirofumi Koge, Tokyo (JP); Koji Azuma, Tokyo (JP)

(72) Inventors: Kosuke Tanaka, Tokyo (JP); Hirofumi Koge, Tokyo (JP); Koji Azuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 307 days.

(21) Appl. No.: 14/653,883

(22) PCT Filed: Jan. 8, 2013

(86) PCT No.: PCT/JP2013/050103

§ 371 (c)(1),
(2) Date: Jun. 19, 2015

(87) PCT Pub. No.: WO2014/108997

PCT Pub. Date: Jul. 17, 2014

(65) Prior Publication Data

US 2015/0330655 A1 Nov. 19, 2015

(51) Int. Cl.
*F24F 11/83* (2018.01)
*F24F 5/00* (2006.01)
(Continued)

(52) U.S. Cl.
CPC ..... *F24F 5/001* (2013.01); *F24F 11/83* (2018.01); *F25B 13/00* (2013.01);
(Continued)

(58) Field of Classification Search
CPC ..... F25B 2313/0252; F25B 39/00; F25B 2600/2501; F28F 1/006; F28F 13/08; F28F 2250/06; F24F 11/83
See application file for complete search history.

(56) References Cited

U.S. PATENT DOCUMENTS 2,872,165 A * 2/1959 Wennerberg ..... F28D 9/005 165/147
6,772,600 B2 * 8/2004 Hwang ..... F25B 13/00 62/160
(Continued)

FOREIGN PATENT DOCUMENTS

EP 1 498 668 A1 1/2005
JP 02-103352 A 4/1990
(Continued)

OTHER PUBLICATIONS

Office Action dated May 12, 2016 in the corresponding CN application No. 201380069776.2 (with English translation).
(Continued)

*Primary Examiner* — Frantz Jules
*Assistant Examiner* — Lionel Nouketcha
(74) *Attorney, Agent, or Firm* — Posz Law Group, PLC

(57) ABSTRACT

An air-conditioning apparatus includes a compressor for compressing and discharging refrigerant; an outdoor heat exchanger for exchanging heat between the refrigerant and a heat medium that enters the outdoor heat exchanger; an indoor heat exchanger for exchanging heat between the refrigerant and a surrounding medium of use; a bypass pipe for bypassing the refrigerant that is to enter the outdoor heat exchanger; and a bypass flow control valve arranged on the bypass pipe, for adjusting a flow of the refrigerant that is to enter the outdoor heat exchanger, in which the outdoor heat exchanger includes a first passage through which the refrigerant flows, and a second passage through which the heat medium flows, and in which the first passage allows the refrigerant to flow upward.

8 Claims, 18 Drawing Sheets

(51) Int. Cl.
*F25B 13/00* (2006.01)
*F28F 1/00* (2006.01)

(52) U.S. Cl.
CPC ... *F25B 2313/004* (2013.01); *F25B 2313/006* (2013.01); *F25B 2313/0231* (2013.01); *F25B 2313/0233* (2013.01); *F25B 2313/0252* (2013.01); *F25B 2313/02741* (2013.01); *F25B 2600/2501* (2013.01); *F28F 1/006* (2013.01)

(56) References Cited

U.S. PATENT DOCUMENTS

| | | | | |
|---|---|---|---|---|
| 2003/0230096 | A1 | 12/2003 | Hwang | |
| 2007/0245752 | A1 | 10/2007 | Honda | |
| 2008/0307813 | A1* | 12/2008 | Lifson | F25B 49/022 62/228.4 |
| 2010/0050675 | A1* | 3/2010 | Kameyama | F24D 17/001 62/238.7 |
| 2011/0259574 | A1* | 10/2011 | Angel | F23L 15/04 165/287 |
| 2012/0192588 | A1* | 8/2012 | Yamashita | F25B 13/00 62/498 |

FOREIGN PATENT DOCUMENTS

| | | | |
|---|---|---|---|
| JP | 05-184181 | A | 7/1993 |
| JP | 2522361 | B | 8/1996 |
| JP | 2000-161808 | A | 6/2000 |
| JP | 2003-343936 | A | 12/2003 |
| JP | 2004-020191 | A | 1/2004 |
| JP | 2007-024320 | A | 2/2007 |
| JP | 2011-089690 | A | 5/2011 |
| KR | 2012 0014445 | A | 2/2012 |
| WO | 2006/003925 | A1 | 1/2006 |

OTHER PUBLICATIONS

International Search Report of the International Searching Authority dated Feb. 26, 2013 for the corresponding international application No. PCT/JP2013/050103 (and English translation).
Extended European Search Report dated Aug. 23, 2016 issued in corresponding EP patent application No. 13870917.5.
Office Action dated Jan. 10, 2017 issued in corresponding CN patent application No. 201380069776.2 (and English translation).

* cited by examiner

AIR-CONDITIONING APPARATUS

CROSS REFERENCE TO RELATED APPLICATION

This application is a U.S. national stage application of PCT/JP2013/050103 filed on Jan. 8, 2013, the disclosure of which is incorporated herein by reference.

TECHNICAL FIELD

The present invention relates to an air-conditioning apparatus.

BACKGROUND

In the related art, capacity control on a heat exchanger has included control to lower, as a heat exchange amount of the heat exchanger, heat conductance defined by an AK value, which is a product of a heat transfer area A ($m^2$) and a heat transmission coefficient K ($W/(m^2 \cdot K)$).

For example, control on an air-cooled heat exchanger has been performed in which a rotation speed of a fan is reduced to reduce an air flow of the fan, and as a result, a heat exchange amount is lowered to lower heat conductance (see, for example, Patent Literature 1).

Moreover, control has been performed in which, for example, an air-cooled heat exchanger is divided into plurality, and when a heat exchange amount is to be lowered, the number of divided air-cooled heat exchangers for use is decreased, with the result that a heat transfer area A ($m^2$) is reduced to lower heat conductance (see, for example, Patent Literature 2).

Moreover, control has been performed in which, for example, refrigerant is bypassed to reduce a refrigerant flow through an air-cooled heat exchanger, and as a result, a heat exchange amount is lowered to lower heat conductance (see, for example, Patent Literature 3).

Moreover, related-art air-conditioning apparatus have included an air-conditioning apparatus including a heat source apparatus-side unit and a load-side unit, in which three-way selector valves respectively arranged in a plurality of indoor heat exchangers included in the load-side unit are switched to form a refrigeration cycle for cooling and a refrigeration cycle for heating in one refrigerant circuit and hence perform a simultaneous cooling and heating operation (see, for example, Patent Literature 4).

PATENT LITERATURE

Patent Literature 1: Japanese Unexamined Patent Application Publication No. Hei 5-184181 (paragraph [0009])

Patent Literature 2: Japanese Unexamined Patent Application Publication No. 2003-343936 (paragraph [0058])

Patent Literature 3: Japanese Unexamined Patent Application Publication No. 2000-161808 (paragraph [0009])

Patent Literature 4: Japanese Patent No. 2522361 (related art)

In the related-art air-conditioning apparatus (Patent Literature 4), to improve reliability of a driver of a compressor, a compression ratio of a predetermined value or more, for example, 2 or more needs to be secured. For example, during a cooling operation and in a case of an air-conditioning operation in a state in which an outdoor temperature is low, or during the cooling operation and in a case of an air-conditioning operation in a state in which a compressor operation capacity is lowered, to secure the compression ratio of the predetermined value or more, heat conductance needs to be lowered.

Moreover, for example, in the related-art air-conditioning apparatus (Patent Literature 4), in the case where the simultaneous cooling and heating operation is performed, a case where a full heat recovery operation is performed among indoor units is assumed. In the full heat recovery operation, an air conditioning load ratio between the cooling operation and a heating operation is substantially equal. Therefore, in the case where the full heat recovery operation is performed, a heat exchange amount in an outdoor heat exchanger needs to be reduced. For example, to perform the full heat recovery operation during a cooling main operation, a heat transfer amount in the outdoor heat exchanger needs to be approximated to zero to reduce the heat exchange amount in the outdoor heat exchanger. Moreover, to perform the full heat recovery operation during a heating main operation, for example, a heat removal amount in the outdoor heat exchanger needs to be approximated to zero to reduce the heat exchange amount in the outdoor heat exchanger. In other words, heat conductance of the outdoor heat exchanger needs to be lowered by a necessary amount.

Moreover, for example, in an indoor unit during the cooling operation, to avoid freezing, an evaporating temperature of 0 degrees Celsius (C) or more needs to be secured, and in a case where a low pressure is lowered, to avoid the freezing of the indoor unit, it has been required to stop the driver of the compressor. Therefore, start and stop of the driver of the compressor have frequently occurred. Here, when it is assumed that the heat conductance of the outdoor heat exchanger arranged in an outdoor unit may be lowered by the necessary amount, the heat exchange amount is decreased, and hence there is no possibility of freezing.

However, the heat conductance may be lowered to a certain value, but there has been a factor that inhibits the lowering of the heat conductance by the necessary amount. In a case where an air-cooled heat exchanger is arranged as the outdoor heat exchanger, for example, to cool an electronic circuit board stored in the outdoor unit, it has been necessary to rotate an outdoor fan at a certain air flow or more. Moreover, in a case where a water-cooled heat exchanger is arranged as the outdoor heat exchanger, for example, to avoid pitting, it has been necessary to cause cooling water to flow at a predetermined speed or more. Therefore, in the related-art air-conditioning apparatus (Patent Literature 4), it has been impossible to lower the heat conductance by the necessary amount.

In other words, in all of the cases described above, because the heat conductance of the outdoor heat exchanger cannot be lowered by the necessary amount, start and stop of the driver of the compressor frequently occur and heat recovery among the indoor units has been inefficient. Therefore, there have been problems in that indoor comfortability is deteriorated and energy saving performance is lowered.

SUMMARY

The present invention has been made to solve the above-mentioned problems, and therefore has an object to provide an air-conditioning apparatus capable of improving indoor comfortability and energy saving performance.

According to one embodiment of the present invention, there is provided an air-conditioning apparatus, including: a compressor for compressing and discharging refrigerant; a heat source apparatus-side heat exchanger for exchanging heat between the refrigerant and a heat medium that enters the heat source apparatus-side heat exchanger; a use-side heat exchanger for exchanging heat between the refrigerant and a surrounding medium of use; a bypass pipe for bypassing the refrigerant that is to enter the heat source apparatus-side heat exchanger; and a bypass flow control valve arranged on the bypass pipe, for adjusting a flow of the refrigerant that is to enter the heat source apparatus-side heat exchanger, in which the heat source apparatus-side heat exchanger includes a first passage through which the refrigerant flows, and a second passage through which the heat medium flows, and in which the first passage allows the refrigerant to flow upward.

The air-conditioning apparatus according to the one embodiment of the present invention may utilize the bypass flow control valve and hydraulic head of an outdoor heat exchanger through which each of refrigerant and the heat medium flows to lower heat conductance of the outdoor heat exchanger by a necessary amount. Therefore, the air-conditioning apparatus according to the one embodiment of the present invention has an effect to improve the indoor comfortability and the energy saving performance.

DETAILED DESCRIPTION

Referring to the accompanying drawings, embodiments of the present invention are described in detail below.

Embodiment 1

In Embodiment 1, a bypass flow control valve 43 and hydraulic head of an outdoor heat exchanger 35 through which each of refrigerant and a heat medium flows are utilized to lower heat conductance of the outdoor heat exchanger 35 by a necessary amount. Therefore, a state in which start and stop of a driver of a compressor frequently occur is avoided, and efficiency of heat recovery among indoor units is also improved, with the result that indoor comfortability and energy saving performance are improved. Now, details of Embodiment 1 are described sequentially with reference to FIG. 1 to FIG. 11. Note that, shapes and sizes of components illustrated in the figures described in Embodiment 1 of the present invention are merely exemplary, and the present invention is not particularly limited thereto.

Figure 1:
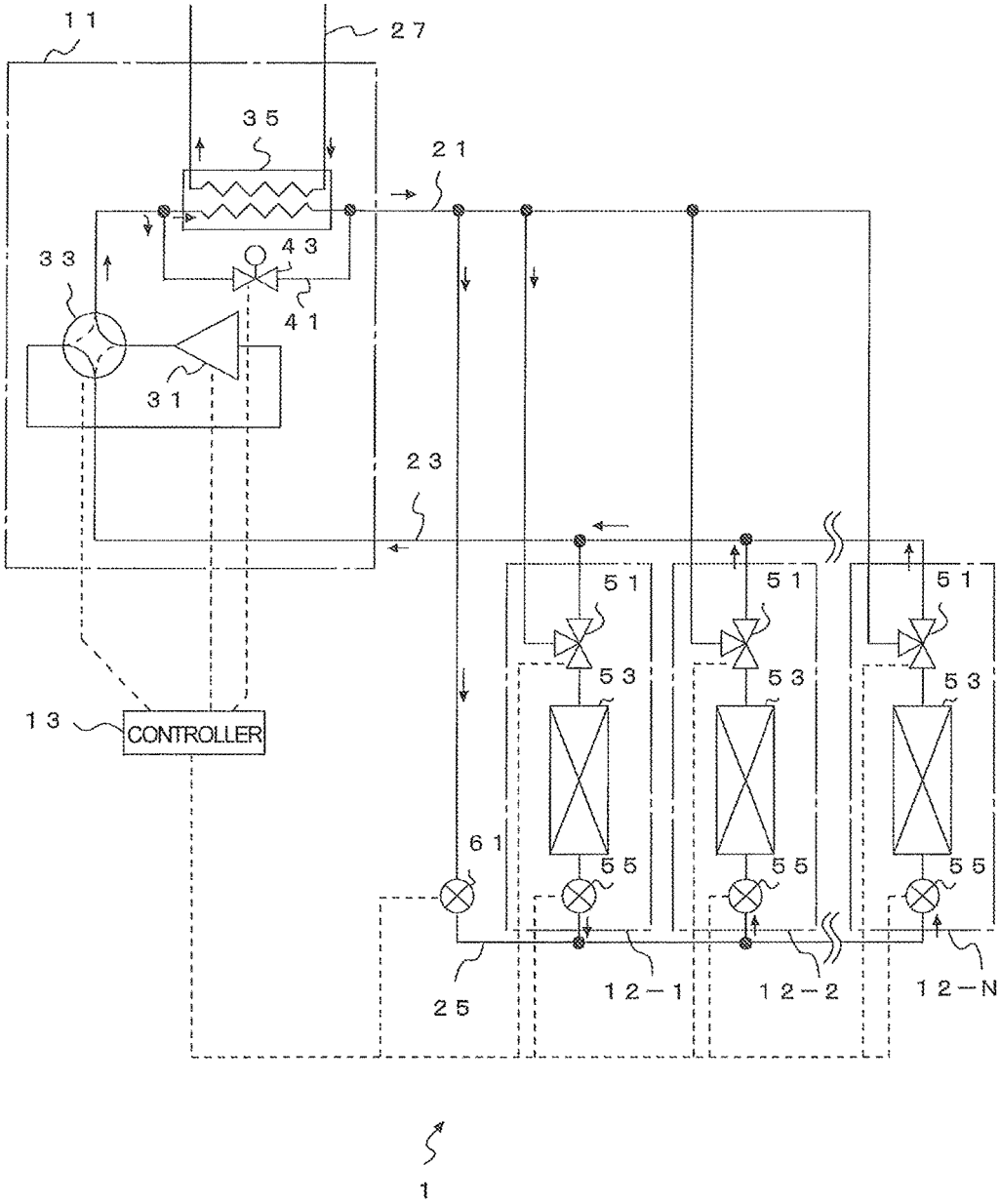
FIG. 1 is a diagram illustrating an example of a refrigerant circuit 1 of an air-conditioning apparatus according to Embodiment 1 of the present invention.

FIG. 1 is a diagram illustrating an example of a refrigerant circuit 1 of an air-conditioning apparatus according to Embodiment 1 of the present invention. As illustrated in FIG. 1, the refrigerant circuit 1 includes an outdoor unit 11, indoor units 12-1 to 12-N, and the like. Between the outdoor unit 11 and the indoor units 12-1 to 12-N, there are arranged a first connecting pipe 21, a second connecting pipe 23, and a third connecting pipe 25, which are described later in detail. The refrigerant circuit 1 also includes a controller 13, and various operations, which are described later, are performed based on commands from the controller 13. The outdoor unit 11 includes a four-way valve 33, which is described later in detail, and the like, and each of the indoor units 12-1 to 12-N includes a three-way selector valve 51, which is described later in detail, and the like. The four-way valve 33 or the three-way selector valve 51 is switched based on a command of the controller 13 to change over a refrigerant passage so that a switch may be made to various operating modes such as a cooling operation, a heating operation, a simultaneous heating-main cooling and heating operation, and a simultaneous cooling-main cooling and heating operation.

For example, a part of the indoor units 12-1 to 12-N is switched to the cooling operation by the three-way selector valve 51, and another part of the indoor units 12-1 to 12-N is switched to the heating operation by the three-way selector valve 51, with the result that a refrigeration cycle for cooling and a refrigeration cycle for heating are formed to execute the simultaneous cooling and heating operation in which the cooling operation and the heating operation are executed simultaneously (Details are described later). Note that, the indoor units 12-1 to 12-N are referred to as "indoor units 12" when no particular distinction is made.

The outdoor unit 11 includes a compressor 31, the four-way valve 33, which has been outlined above, the outdoor heat exchanger 35, and the like. The outdoor unit 11 also includes a bypass pipe 41 and the bypass flow control valve 43. Note that, the outdoor heat exchanger 35 corresponds to a heat source apparatus-side heat exchanger in the present invention.

The compressor 31 has a discharge side and a suction side connected to two out of four ports of the four-way valve 33, respectively. The compressor 31 compresses and discharges refrigerant to supply high temperature, high pressure refrigerant gas to the refrigerant circuit 1.

The four-way valve 33 has the four ports, which are connected to the discharge side of the compressor 31, the outdoor heat exchanger 35, the suction side of the compressor 31, and the second connecting pipe 23, respectively, to change over the passage of the refrigerant.

The outdoor heat exchanger 35 is arranged between the four-way valve 33 and the first connecting pipe 21. The outdoor heat exchanger 35 is formed of, for example, a water-cooled heat exchanger and the refrigerant and a heat medium that has entered the outdoor heat exchanger 35 flow along a direction of gravity 95, which is described later in FIG. 2, to exchange heat, which is described later in detail. Note that, the heat medium is, for example, cooling water such as water or brine but the present invention is not particularly limited thereto.

Note that, in the following description, the outdoor heat exchanger 35 is described to be formed as the water-cooled heat exchanger, but the present invention is not particularly limited thereto. For example, the outdoor heat exchanger 35 may be an air-cooled heat exchanger. In this case, the air-cooled heat exchanger includes a fan, and a rotation speed of the fan is adjusted to adjust a heat exchange amount between the refrigerant in the air-cooled heat exchanger and the heat medium around the air-cooled heat exchanger. Moreover, in this case, the heat medium is, for example, air but the present invention is not particularly limited thereto.

The bypass pipe 41 is a refrigerant pipe for connecting an inlet side and an outlet side of the refrigerant of the outdoor heat exchanger 35 in a shunting manner to bypass a part of the refrigerant that is to enter the outdoor heat exchanger 35 to the outside of the outdoor heat exchanger 35. The refrigerant flows through the bypass pipe 41 to decrease the refrigerant that flows through the outdoor heat exchanger 35. In other words, the flow of the refrigerant through the bypass pipe 41 is adjusted to adjust the flow of the refrigerant through the outdoor heat exchanger 35.

The bypass flow control valve 43 is a flow control valve arranged on the bypass pipe 41 and having a variable opening degree to adjust the flow of the refrigerant through the bypass pipe 41.

Each of the indoor units 12 includes the three-way selector valve 51, which has been outlined above, an indoor heat exchanger 53, a first expansion valve 55, and the like. In FIG. 1, an example in which N indoor units 12 are arranged is described. However, the specific number of indoor units 12 is not particularly limited, and the number of indoor units 12 that is necessary for the various operating modes such as the simultaneous cooling and heating operation may be arranged depending on the execution environment. Note that, the indoor heat exchanger 53 corresponds to a use-side heat exchanger in the present invention.

The three-way selector valve 51 has three ports, which are connected to the first connecting pipe 21, the second connecting pipe 23, a refrigerant pipe arranged to the indoor heat exchanger 53, respectively, to change over the passage of the refrigerant.

The indoor heat exchanger 53 is arranged between the three-way selector valve 51 and the first expansion valve 55. The indoor heat exchanger 53 is formed as, for example, an air-cooled heat exchanger to exchange heat between the refrigerant and a surrounding medium of use. Note that, a rotation speed of a fan arranged in the indoor heat exchanger 53 is controlled, with the result that a flow of the medium of use, for example, air around the indoor heat exchanger 53 is changed to adjust a heat exchange amount in the indoor heat exchanger 53 (The illustration is omitted).

The first expansion valve 55 is arranged between the indoor heat exchanger 53 and the third connecting pipe 25. The first expansion valve 55 is a flow control valve having a variable opening degree, and has a function of adjusting a flow of the refrigerant between the indoor heat exchanger 53 and the third connecting pipe 25, and a function of throttling and expanding the high pressure refrigerant liquid through a low pressure portion.

The first connecting pipe 21 is arranged between the outdoor heat exchanger 35 and the first port of the three-way selector valve 51. The first connecting pipe 21 is also connected at a junction formed halfway through the first connecting pipe 21 to the third connecting pipe 25. The second connecting pipe 23 is arranged between one port of the four-way valve 33 and the second port of the three-way selector valve 51. Note that, the third port of the three-way selector valve 51 is connected, as described above, to the refrigerant pipe arranged to the indoor heat exchanger 53. The third connecting pipe 25 is arranged between the junction formed halfway through the first connecting pipe 21 and the first expansion valve 55. The third connecting pipe 25 includes a second expansion valve 61. The second expansion valve 61 is a flow control valve having a variable opening degree, and has a function of adjusting a flow of the refrigerant through the third connecting pipe 25, and a function of throttling and expanding the high pressure refrigerant liquid through the low pressure portion.

The controller 13 is mainly formed of, for example, a microprocessor unit to issue commands on control on the outdoor unit 11, control on the indoor units 12, and control for coordination of the outdoor unit 11 and the indoor units 12, and the like.

In other words, the outdoor unit 11 and the indoor units 12-1 to 12-N are connected in parallel via the first connecting pipe 21, the second connecting pipe 23, and the third connecting pipe 25. With this connection configuration, the controller 13 may switch, among the indoor units 12-1 to 12-N, the indoor units 12 for the heating operation and the indoor units 12 for the cooling operation by the three-way selector valves 51. Therefore, in the refrigerant circuit 1, the refrigeration cycle for cooling and the refrigeration cycle for heating are formed, and hence the simultaneous cooling and heating operation in which the cooling operation and the heating operation are executed simultaneously may be executed.

Figure 2:
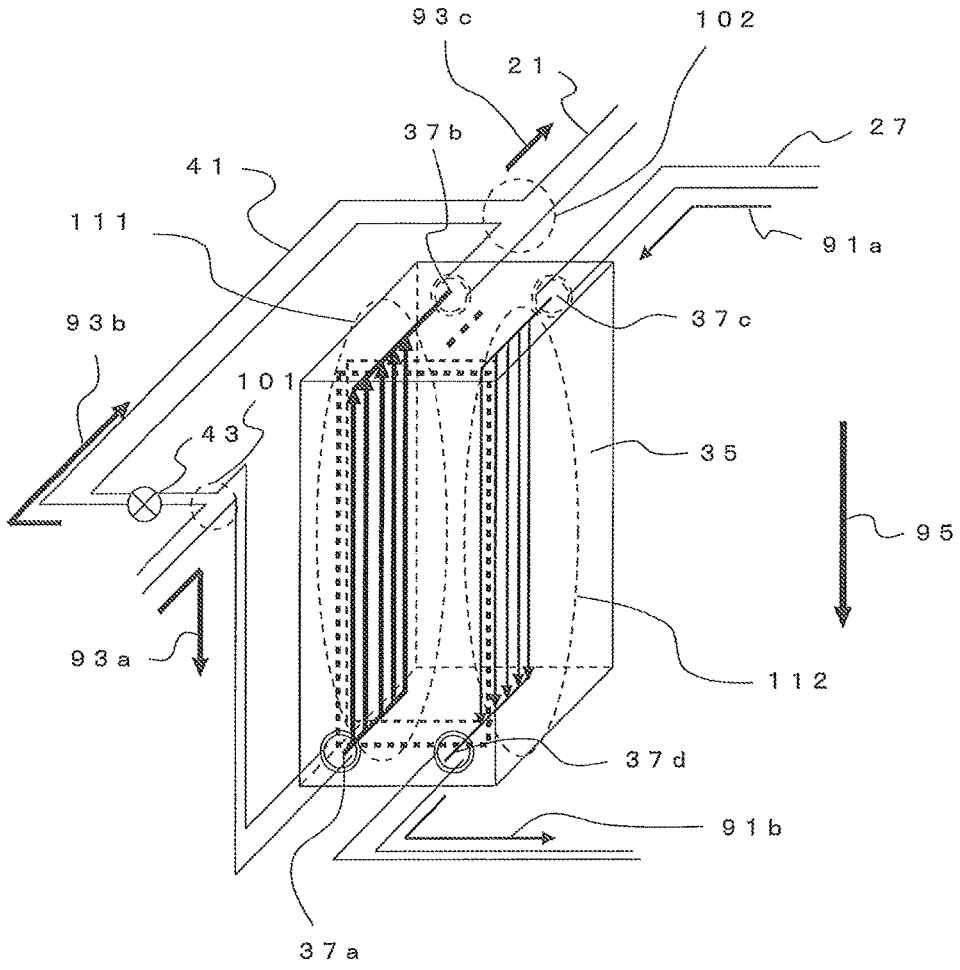
FIG. 2 is a diagram illustrating an example of a schematic configuration of an outdoor heat exchanger 35 according to Embodiment 1 of the present invention.

Next, with the above-mentioned configuration of the refrigerant circuit 1 as a precondition, details of the outdoor heat exchanger 35 are described. FIG. 2 is a diagram illustrating an example of a schematic configuration of the outdoor heat exchanger 35 according to Embodiment 1 of the present invention. The outdoor heat exchanger 35 is formed into a shape having a longitudinal direction along the direction of gravity 95. The outdoor heat exchanger 35 includes an opening 37*a*, an opening 37*b*, an opening 37*c*, and an opening 37*d*. The opening 37*a* and the opening 37*b* are an inlet and an outlet through which the refrigerant flows. The opening 37*c* and the opening 37*d* are an inlet and an outlet through which the heat medium, for example, the cooling water flows.

The opening 37*a* and the opening 37*d* are formed, in a case where a direction indicated by the arrow of the direction of gravity 95 is defined as a lower side, on the lower side of the outdoor heat exchanger 35. The opening 37*b* and the opening 37*c* are formed, in the case where the direction indicated by the arrow of the direction of gravity 95 is defined as the lower side, on an upper side of the outdoor heat exchanger 35. In other words, the refrigerant flows along the direction of gravity 95. The heat medium, for example, the cooling water also flows along the direction of gravity 95.

Inside the outdoor heat exchanger 35, a first passage 111 through which the refrigerant flows, and a second passage 112 through which the heat medium, for example, the cooling water flows face each other along the direction of gravity 95. For example, in a case where the outdoor heat exchanger 35 is formed as a plate type heat exchanger, the first passage 111 and the second passage 112 include the passage of the refrigerant flowing through the plate type heat exchanger.

The refrigerant pipe connected to one of the four ports of the four-way valve 33 illustrated in FIG. 1 has one end branching at a first furcation 101 into the bypass pipe 41 and a refrigerant pipe that leads to the opening 37*a*. The bypass pipe 41 is arranged at a position higher than the opening 37*a* and the opening 37*b*. On the other hand, the refrigerant pipe that leads to the opening 37*a* is extended, in the case where the direction indicated by the arrow of the direction of gravity 95 is defined as the lower side, to the lower side to be connected to the opening 37*a*.

More specifically, the bypass pipe 41 has a first end and a second end. The bypass pipe 41 has the first end connected to the first furcation 101 from which the opening 37*a* side and the refrigerant pipe connected to the four-way valve 33 branch off. The bypass pipe 41 also has the second end connected to a second furcation 102 from which the opening 37*b* side and the first connecting pipe 21 branch off.

In the connection configuration described above, a bypass passage for bypassing the outdoor heat exchanger 35 without flowing through the outdoor heat exchanger 35 is formed. On the other hand, the opening 37*c* and the opening 37*d* are connected to a cooling water pipe 27. The cooling water pipe 27 is connected to, for example, a pump (not shown) or the like, and the cooling water flows therethrough along with driving of the pump or the like. Note that, the bypass flow control valve 43 is arranged on the bypass pipe 41, and hence the bypass flow control valve 43 is also arranged at a position higher than the opening 37*a* and the opening 37*b*. Moreover, the first furcation 101 and the second furcation 102 are arranged at the height of the bypass flow control valve 43.

When the operating mode is the cooling operation or a cooling main operation, the refrigerant travels along refrigerant traveling directions 93*a*, 93*b*, and 93*c* to flow from the opening 37*a* to the opening 37*b*. On the other hand, when the operating mode is the heating operation or a heating main operation, the refrigerant flows from the opening 37*b* to the opening 37*a* by traveling in an opposite direction to when in the cooling operation or the cooling main operation. Note that, the refrigerant traveling directions 93*a*, 93*b*, and 93*c* are referred to as "refrigerant traveling directions 93" when no particular distinction is made. Moreover, in any operating mode, the cooling water travels along cooling water traveling directions 91*a* and 91*b* to flow from the opening 37*c* to the opening 37*d*. Note that, the traveling directions described above are merely an example, and the present invention is not limited thereto.

A phenomenon that occurs by the refrigerant flowing through the outdoor heat exchanger 35 is described. During the cooling operation, in the first passage 111 formed between the opening 37*a* and the opening 37*b*, the refrigerant flows from the opening 37*a* toward the opening 37*b*. Therefore, in the first passage 111, a pressure difference ΔPf resulting from a friction loss is generated, and a pressure difference ΔPw resulting from hydraulic head generated by condensate of the refrigerant is generated. Here, it is assumed that the opening degree of the bypass flow control valve 43 has been adjusted to open the bypass flow control valve 43. In other words, it is assumed that a Cv value, which is a flow coefficient in the bypass pipe 41, has been increased. At this time, a passage resistance in the bypass pipe 41 is decreased to increase the flow of the refrigerant in the bypass pipe 41.

Therefore, the flow of the refrigerant bypassing the outdoor heat exchanger 35 is increased, and hence the flow of the refrigerant through the outdoor heat exchanger 35 is lowered to lower a flow velocity of the refrigerant flowing through the outdoor heat exchanger 35. In general, the pressure difference ΔPf resulting from the friction loss is proportional to the 1.75th power of the flow velocity, and hence as the flow velocity of the refrigerant becomes lower, the pressure difference ΔPf resulting from the friction loss becomes smaller.

On the other hand, regarding the pressure difference ΔPw resulting from the hydraulic head generated by the condensate of the refrigerant, the first passage 111, which is the passage of the refrigerant flowing through the outdoor heat exchanger 35, is formed along the direction of gravity 95.

Therefore, as a liquid column height of the outdoor heat exchanger 35 increases, the pressure difference ΔPw resulting from the hydraulic head generated by the condensate of the refrigerant is increased. Moreover, in the outdoor heat exchanger 35, a liquid column resulting from the condensate is generated. Moreover, the first furcation 101 is arranged at the height of the bypass flow control valve 43, and hence the first furcation 101 is arranged at a position higher than the opening 37*b* of the outdoor heat exchanger 35. Therefore, in the outdoor heat exchanger 35, the effect of the pressure difference ΔPw resulting from the hydraulic head generated by the condensate of the refrigerant may be increased. Note that, in the following description, the pressure difference ΔPf resulting from the friction loss is referred to as "pressure difference ΔPf". Moreover, the pressure difference ΔPw resulting from the hydraulic head generated by the condensate of the refrigerant is referred to as "pressure difference ΔPw".

Note that, the opening 37*a* or the opening 37*b* corresponds to a refrigerant inflow opening in the present invention. Moreover, the openings 37*a* to 37*d* are referred to as "openings 37" when no particular distinction is made. Moreover, the first passage 111 and the second passage 112 formed in the outdoor heat exchanger 35 are illustrated in a modeled state in FIG. 2, and the actual shape does not need to be formed in a simple shape of traveling in one direction as illustrated in FIG. 2.

Next, with the above-mentioned components of the refrigerant circuit 1 as a precondition, the effect of the hydraulic head in the outdoor heat exchanger 35, which is a main part in Embodiment 1 of the present invention, is described with reference to FIG. 3 to FIG. 5.

Figure 3:
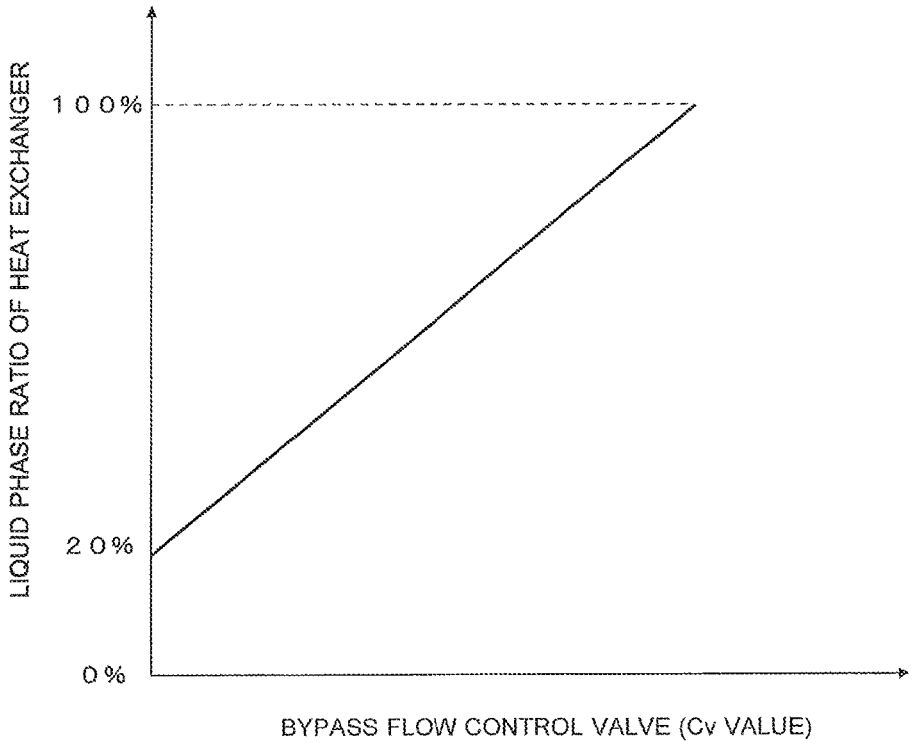
FIG. 3 is a graph showing an example of a correlation between a Cv value of a bypass flow control valve 43 and a liquid phase ratio of the outdoor heat exchanger 35 in Embodiment 1 of the present invention.

FIG. 3 is a graph showing an example of a correlation between the Cv value of the bypass flow control valve 43 and a liquid phase ratio of the outdoor heat exchanger 35 in Embodiment 1 of the present invention. In FIG. 3, the horizontal axis indicates the Cv value, which is an opening degree change amount of the bypass flow control valve 43, that is, the Cv value of the bypass flow control valve 43, and the vertical axis indicates a liquid phase ratio of the outdoor heat exchanger 35. As described above with reference to FIG. 2, as the flow of the refrigerant through the bypass pipe 41 becomes larger, the flow velocity of the refrigerant flowing through the outdoor heat exchanger 35 becomes lower. In other words, as the Cv value of the bypass flow control valve 43 becomes larger, the flow velocity of the refrigerant flowing through the outdoor heat exchanger 35 becomes lower. As the flow velocity of the refrigerant flowing through the outdoor heat exchanger 35 becomes lower, heat exchange efficiency between the refrigerant and the cooling water becomes higher, and hence the liquid phase ratio of the outdoor heat exchanger 35 becomes higher.

Note that, as described above, in this specification, the Cv value is used not as a fixed value specific to the pipe, but as a flow of the refrigerant through the bypass pipe 41, which is changed depending on the opening degree of the bypass flow control valve 43.

Therefore, as illustrated in FIG. 3, as the Cv value of the bypass flow control valve 43 becomes larger, the liquid phase ratio of the outdoor heat exchanger 35 becomes higher. Note that, in a case where the refrigerant does not flow through the bypass pipe 41, that is, in a case where the refrigerant is not diverted to the outside of the outdoor heat exchanger 35, a coefficient of performance (COP) of the refrigeration cycle becomes the highest in a state in which a degree of subcooling is secured at the outlet of the outdoor heat exchanger 35 (for example, liquid phase ratio of about 20%), and hence the time when the Cv value of the bypass flow control valve 43 is 0 is defined as the liquid phase ratio of 20% in the outdoor heat exchanger 35, but the present invention is not particularly limited thereto.

In short, as the flow of the refrigerant through the bypass pipe 41 is increased, the liquid phase ratio of the outdoor heat exchanger 35 is increased, and hence the pressure difference $\Delta Pw$ is also increased. In another respect, the first passage 111 through which the refrigerant flows is formed in the outdoor heat exchanger 35, and hence the pressure difference $\Delta Pw$ originally exists in the outdoor heat exchanger 35. Then, as the flow velocity of the refrigerant flowing through the first passage 111 in the outdoor heat exchanger 35 becomes lower, the pressure difference $\Delta Pw$ becomes larger. Therefore, the flow of the refrigerant through the bypass pipe 41 is increased more as the flow of the refrigerant bypassing the bypass pipe 41 is increased more because the flow to the outdoor heat exchanger 35 is inhibited by the pressure difference $\Delta Pw$.

As a result, as the refrigerant flowing through the bypass pipe 41 is increased, the refrigerant flowing through the outdoor heat exchanger 35 is reduced with the elapse of time until almost no refrigerant flows therethrough. Therefore, as the heat exchange amount of the outdoor heat exchanger 35, a value of a heat transmission coefficient K ($W/(m^2 \cdot K)$), which is a parameter of heat conductance defined by an AK value, which is a product of a heat transfer area A ($m^2$) and the heat transmission coefficient K ($W/(m^2 \cdot K)$), approaches zero. Therefore, an air-conditioning operation may be continued in a state in which the refrigerant and the cooling water do not exchange heat in the outdoor heat exchanger 35.

Figure 4:
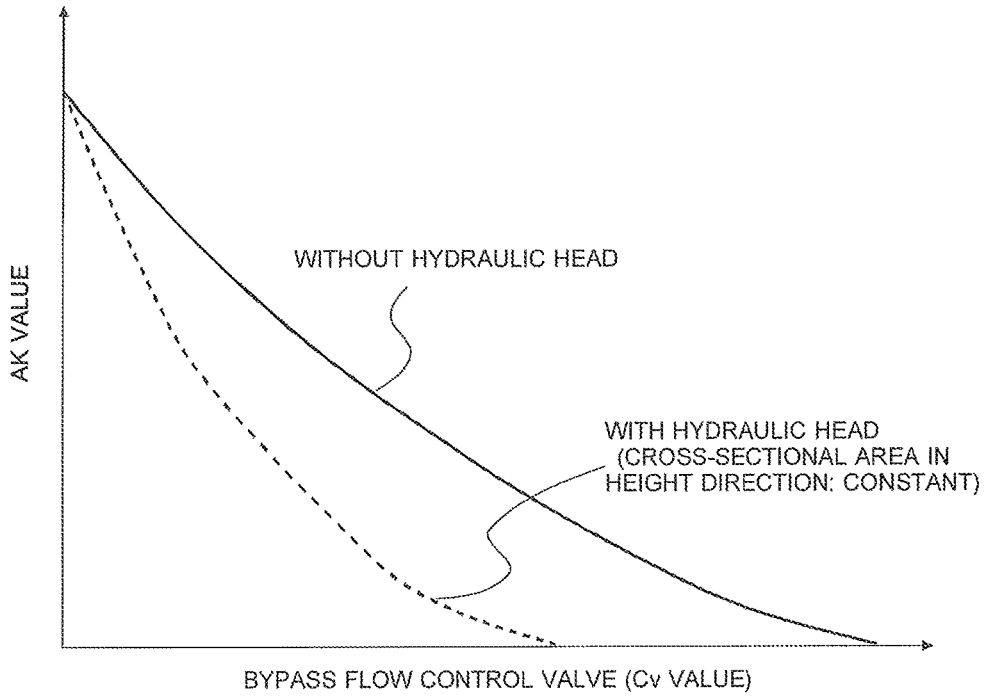
FIG. 4 is a graph showing an example of a correlation between the Cv value of the bypass flow control valve 43 and an AK value in a case where a compressor operation capacity is a fixed value in Embodiment 1 of the present invention.

Next, cases with and without the effect of the hydraulic head are compared with reference to FIG. 4. FIG. 4 is a graph showing an example of a correlation between the Cv value of the bypass flow control valve 43 and the AK value in a case where a compressor operation capacity is a fixed value in Embodiment 1 of the present invention. In FIG. 4, the horizontal axis indicates the Cv value of the bypass flow control valve 43, and the vertical axis indicates the AK value. In an outdoor heat exchanger in the related art, a heat transfer pipe, which is a refrigerant passage in the outdoor heat exchanger, is arranged horizontally. Therefore, in the outdoor heat exchanger in the related art, there is no hydraulic head, and hence a decrease rate of the AK value with respect to the Cv value is small as shown in FIG. 4.

In other words, even if the bypass pipe 41 is connected to the outdoor heat exchanger in the related art, the bypass flow control valve 43 is arranged on the bypass pipe 41, and the opening degree of the bypass flow control valve 43 is adjusted to gradually open the bypass flow control valve 43, the decrease rate of the AK value of the outdoor heat exchanger in the related art, in which there is no hydraulic head, is smaller than the decrease rate of the AK value of the outdoor heat exchanger 35 in Embodiment 1 of the present invention with the hydraulic head. Note that, in FIG. 4, as described above, no special design is applied to cross-sectional areas in a height direction of the outdoor heat exchanger 35, and a case where the cross-sectional areas in the height direction is constant is illustrated.

Next, on a precondition that the outdoor heat exchanger 35 having the effect of the hydraulic head is used, changes in the Cv value and the AK value when an operation capacity of the compressor 31 is changed are described with reference to FIG. 5. FIG. 5 is a graph showing an example of a correlation between the Cv value of the bypass flow control valve 43 and the AK value in a case where the compressor operation capacity is a variable value in Embodiment 1 of the present invention. In FIG. 5, the horizontal axis indicates the Cv value of the bypass flow control valve 43, and the vertical axis indicates the AK value. As the operation capacity of the compressor 31 becomes lower, the flow velocity of the refrigerant flowing through the first passage 111 in the outdoor heat exchanger 35 becomes lower. The reduction in flow velocity of the refrigerant in the first passage 111 corresponds to a reduction in heat transfer area A ($m^2$), which is one parameter of the AK value. Note that, the heat transfer area A ($m^2$) in this case corresponds to a heat transfer area inside the pipe.

Figure 5:
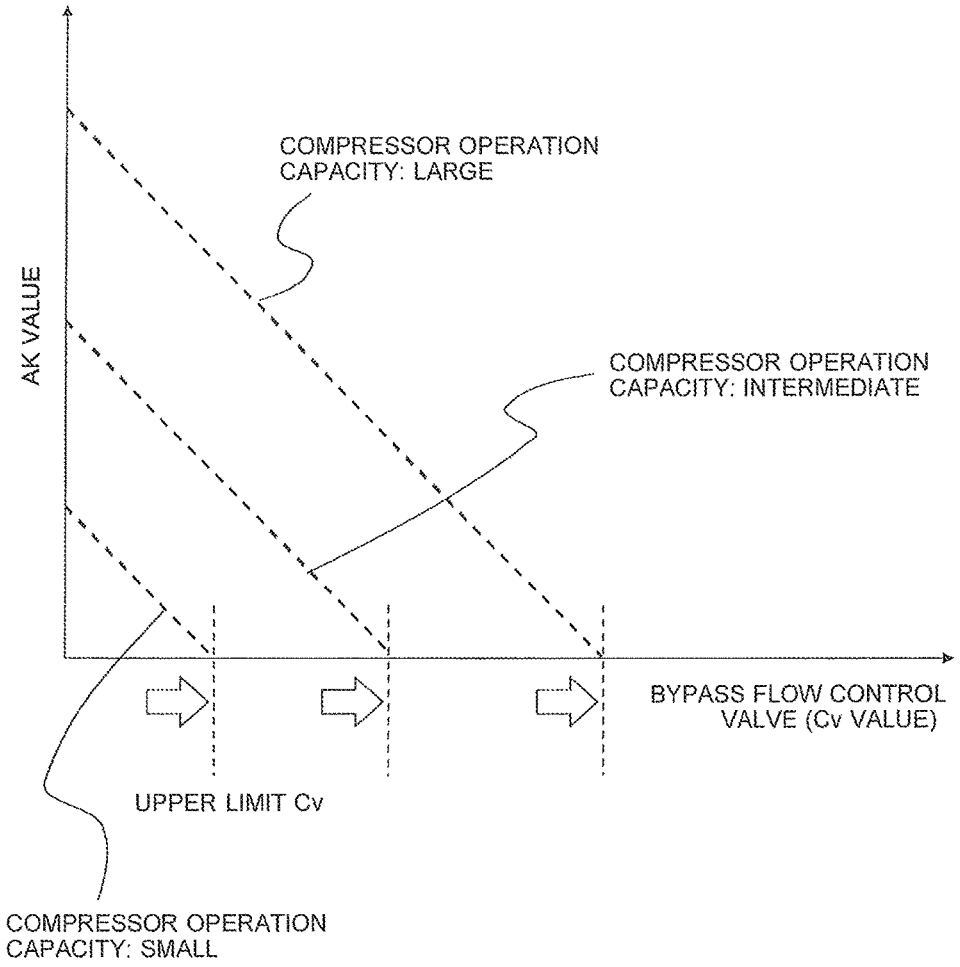
FIG. 5 is a graph showing an example of a correlation between the Cv value of the bypass flow control valve 43 and the AK value in a case where the compressor operation capacity is a variable value in Embodiment 1 of the present invention.

Therefore, as shown in FIG. 5, as the operation capacity of the compressor 31 becomes smaller, the AK value becomes smaller. In other words, as the operation capacity of the compressor 31 becomes smaller, a Cv value at which the AK value becomes zero is different. Therefore, as described later with reference to a flow chart, an upper limit opening degree of the bypass flow control valve 43 is set depending on the operation capacity of the compressor 31. Note that, the AK value becoming zero means a state in which the refrigerant to flow into the outdoor heat exchanger 35 is totally bypassed.

Figure 7:
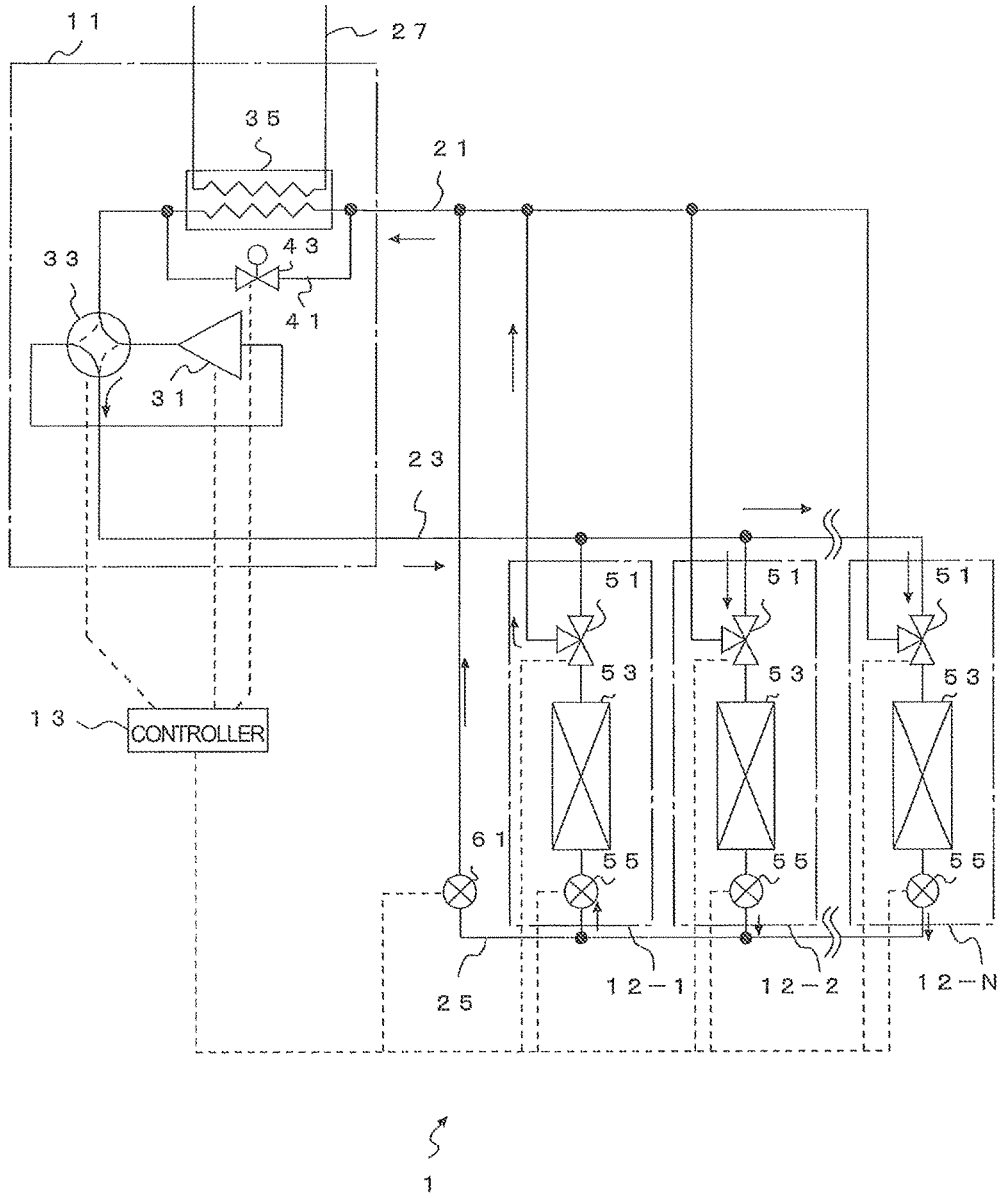
FIG. 7 is an example of a refrigerant circulation diagram illustrating an operational state in a simultaneous cooling and heating operation and in a case of mainly heating in Embodiment 1 of the present invention.
Figure 8:
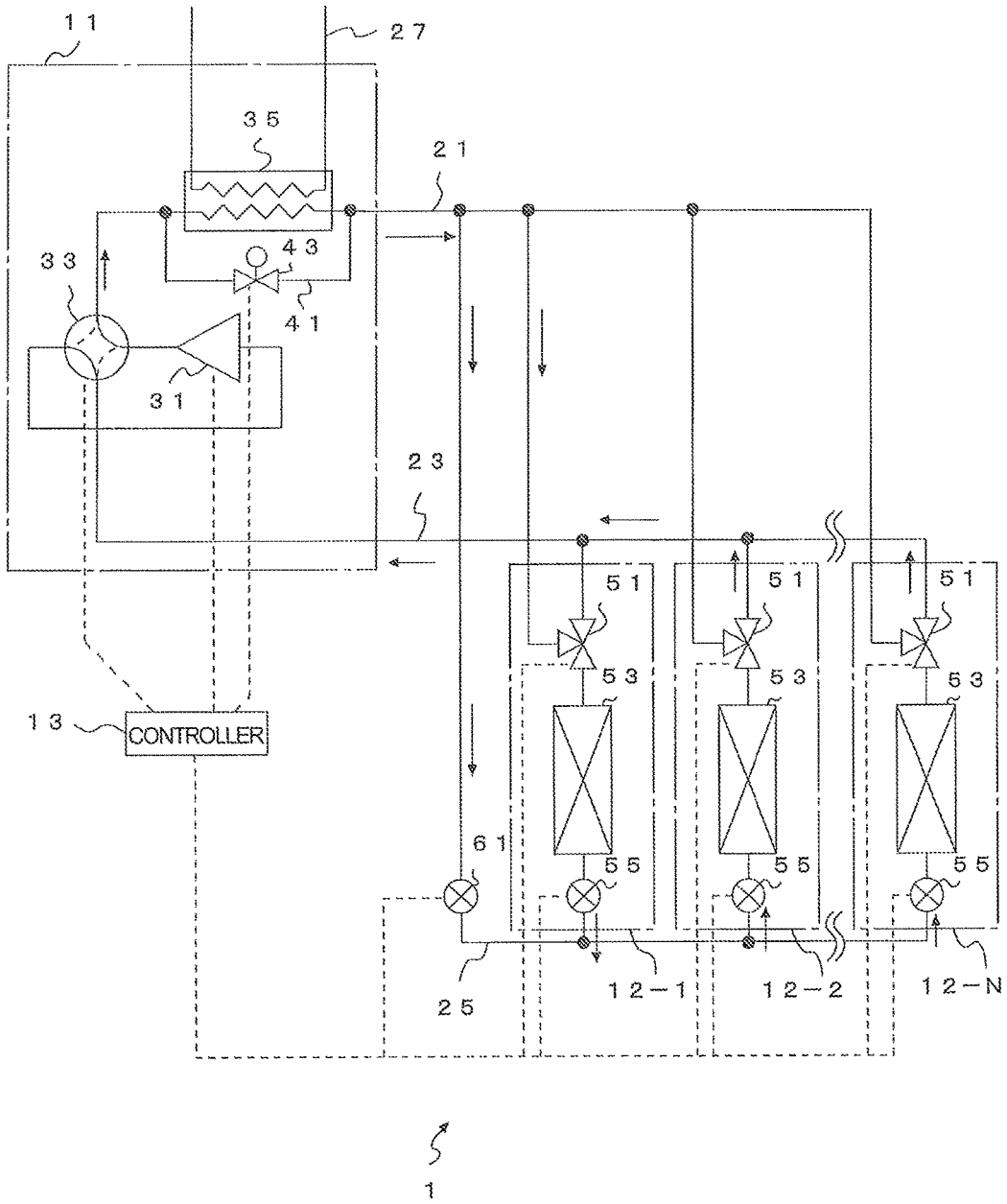
FIG. 8 is an example of a refrigerant circulation diagram illustrating an operational state in the simultaneous cooling and heating operation and in a case of mainly cooling in Embodiment 1 of the present invention.

Next, with the above description as a precondition, operational states in respective cases of various operating modes are described with reference to FIG. 6 to FIG. 8.

Figure 6:
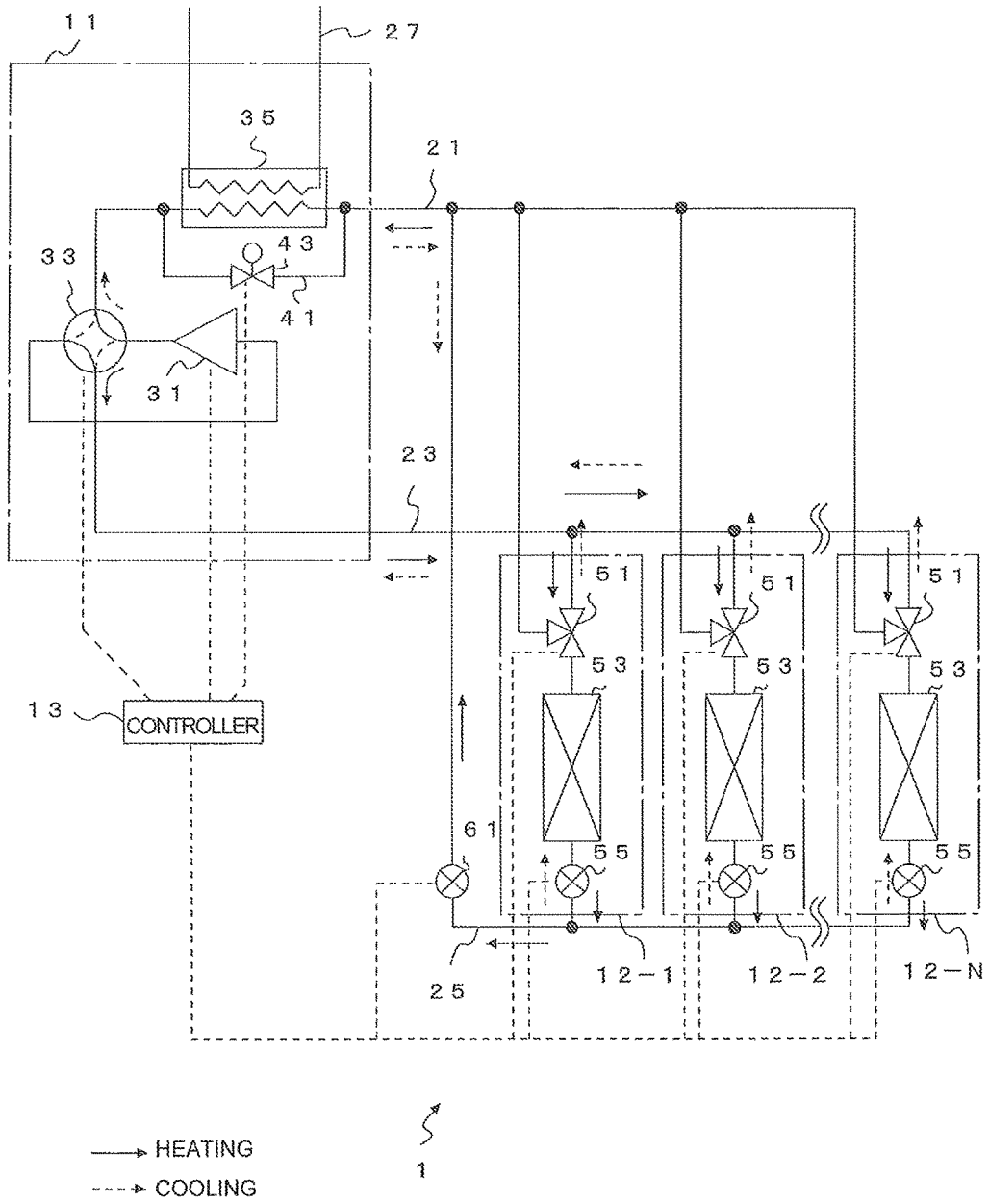
FIG. 6 is an example of a refrigerant circulation diagram illustrating an operational state in a case of only cooling or heating in Embodiment 1 of the present invention.

FIG. 6 is an example of a refrigerant circulation diagram illustrating an operational state in a case of only cooling or heating in Embodiment 1 of the present invention. FIG. 7 is an example of a refrigerant circulation diagram illustrating an operational state in the simultaneous cooling and heating operation and in a case of mainly heating in Embodiment 1 of the present invention. FIG. 8 is an example of a refrigerant circulation diagram illustrating an operational state in the simultaneous cooling and heating operation and in a case of mainly cooling in Embodiment 1 of the present invention.

First, the case of the heating only operation is described with reference to FIG. 6. The high temperature, high pressure refrigerant gas discharged from the compressor 31 is guided by the second connecting pipe 23 from an outdoor side to an indoor side, flows into the indoor heat exchanger 53 through the three-way selector valves 51 of the respective indoor units 12-1 to 12-N, and exchanges heat with (heats) indoor air to be condensed and liquified. Next, the refrigerant that has become the liquid state flows through each of the first expansion valves 55 and into the third connecting pipe 25 to merge, and then flows through the second expansion valve 61. At this time, the refrigerant is reduced in pressure to a low pressure, two-phase gas-liquid state by any one of the first expansion valve 55 and the second expansion valve 61. Next, the refrigerant that has been reduced in pressure to the low pressure flows through the first connecting pipe 21 and into the outdoor heat exchanger 35 of the outdoor unit 11, exchanges heat in the outdoor heat exchanger 35 to become a gaseous state, and is suctioned again by the compressor 31. As a result, a circulation cycle of the refrigerant is formed to perform the heating operation.

Next, a case of the cooling only operation is described with reference to FIG. 6. After exchanging heat and being condensed and liquified in the outdoor heat exchanger 35, the high temperature, high pressure refrigerant gas discharged from the compressor 31 flows through the first connecting pipe 21 and the third connecting pipe 25 in the stated order and into each of the indoor units 12-1 to 12-N. Next, the refrigerant that has flown into each of the indoor units 12-1 to 12-N is reduced in pressure to a low pressure by the first expansion valve 55, flows into the indoor heat exchanger 53, and exchanges heat with (cools) the indoor air to be evaporated and gasified. Next, the refrigerant that has become the gaseous state flows through the three-way selector valves 51 and the second connecting pipe 23 to be suctioned by the compressor 31. As a result, a circulation cycle of the refrigerant is formed to perform the cooling operation.

Next, the simultaneous heating-main cooling and heating operation is described with reference to FIG. 7. Here, it is assumed that the indoor unit 12-1 is in a cooling operation state, and that the indoor units 12-2 to 12-N are in a heating operation state. The refrigerant discharged from the compressor 31 flows, for example, from the second connecting pipe 23 into the indoor units 12-2 to 12-N in the heating operation state through the three-way selector valves 51, exchanges heat with (heats) the indoor air in the indoor heat exchangers 53 in the respective indoor units 12-2 to 12-N, and is condensed and liquified. Next, the refrigerant that has been condensed and liquified flows through the first expansion valve 55, which is substantially in a fully open state, and into the third connecting pipe 25.

Of refrigerant liquid that has flown into the third connecting pipe 25, a part of the refrigerant liquid flows into the indoor unit 12-1, which is in the cooling operation state, flows into the indoor heat exchanger 53 of the indoor unit 12-1 after being reduced in pressure by the first expansion valve 55, exchanges heat with (cools) the indoor air, is evaporated to become the gaseous state, and flows through the three-way selector valve 51 and into the first connecting pipe 21. On the other hand, of the refrigerant liquid that has flown into the third connecting pipe 25, the other refrigerant liquid flows from the third connecting pipe 25 into the first connecting pipe 21 after being reduced in pressure to the low pressure by the second expansion valve 61, merges with the refrigerant from the indoor unit 12-1, which is in the cooling operation state, and exchanges heat in the outdoor heat exchanger 35, and the refrigerant is evaporated into the gaseous state, and then flows back to the compressor 31. As a result, a circulation cycle of the refrigerant is formed to perform the simultaneous heating-main cooling and heating operation.

Next, the simultaneous cooling-main cooling and heating operation is described with reference to FIG. 8. Here, it is assumed that the indoor unit 12-1 is in a heating operation state, and that the indoor units 12-2 to 12-N are in a cooling operation state. The refrigerant discharged from the compressor 31 flows into the outdoor heat exchanger 35, exchanges heat by an arbitrary amount depending on the flow of the heat medium such as the cooling water flowing through the cooling water pipe 27 to become a two-phase gas-liquid high temperature, high pressure state, and is guided by the first connecting pipe 21 from the outdoor side to the indoor side.

Next, of the refrigerant flowing through the first connecting pipe 21, a part of the refrigerant is introduced into the indoor unit 12-1, which is in the heating operation state, and into the indoor heat exchanger 53 in the indoor unit 12-1 through the three-way selector valve 51, exchanges heat with (heats) the indoor air to be condensed and liquified, and flows from the first expansion valve 55 in the indoor unit 12-1 into the third connecting pipe 25. On the other hand, of the refrigerant flowing through the first connecting pipe 21, the other refrigerant flows through the third connecting pipe 25 and through the second expansion valve 61, which is in a fully open state, and merges with the refrigerant from the indoor unit 12-1, which is in the heating operation state.

Next, the merged refrigerant flows from the third connecting pipe 25 into the indoor heat exchangers 53 in the indoor units 12-2 to 12-N, which are in the cooling operation state, after being reduced in pressure to a low pressure state by the first expansion valves 55 in the respective indoor units 12-2 to 12-N, and exchanges heat with (cools) the indoor air to be evaporated into the gaseous state. Next, the refrigerant that has become the gaseous state flows through the three-way selector valve 51 and into the second connecting pipe 23, and then returns back to the compressor 31. As a result, a circulation cycle of the refrigerant is formed to perform the simultaneous cooling-main cooling and heating operation.

Next, of the various operating modes described above, a heat recovery operation during the cooling main operation is described with reference to FIG. 9, and a heat recovery operation during the heating main operation is described with reference to FIG. 10.

Figure 9:
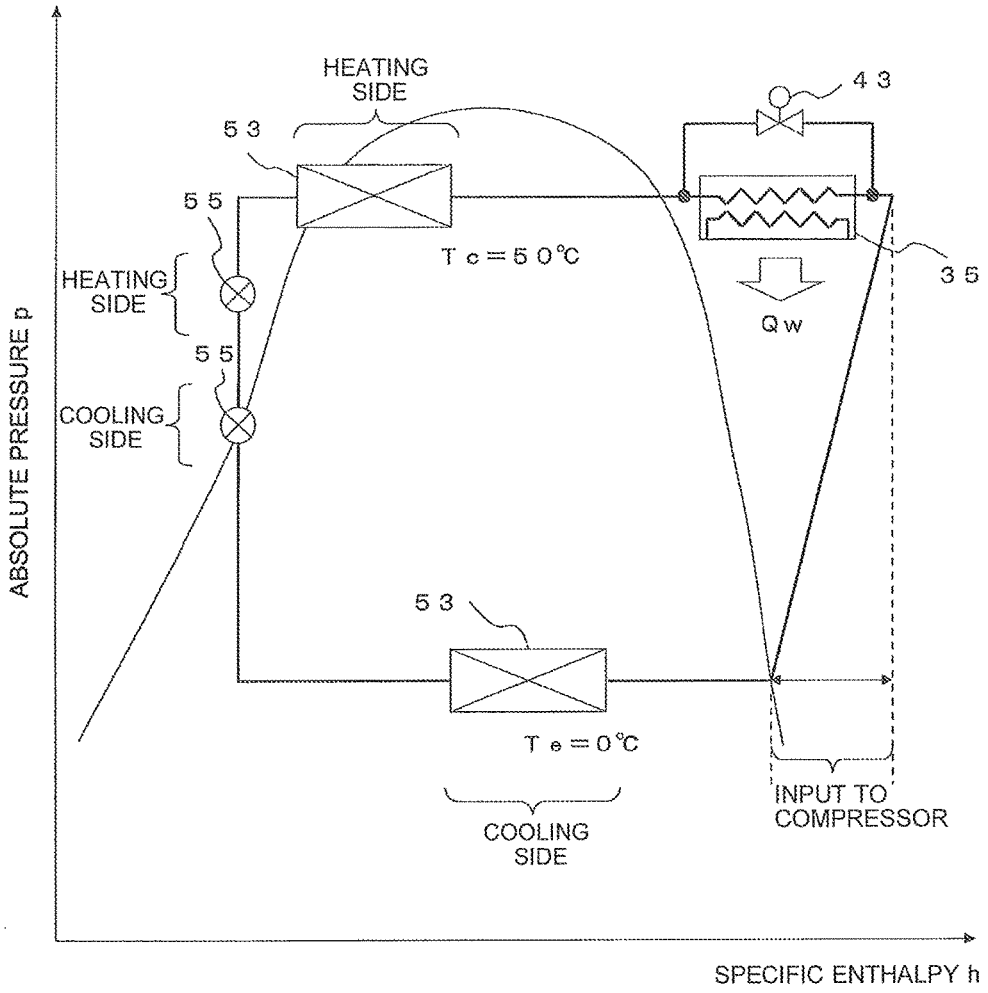
FIG. 9 is an example of a p-h diagram during a cooling main operation in Embodiment 1 of the present invention.

FIG. 9 is an example of a p-h diagram during the cooling main operation in Embodiment 1 of the present invention. In the cooling main operation, the outdoor heat exchanger 35 has the function of a condensor as described above. Therefore, an amount of heat obtained by subtracting a heating air-conditioning load from a sum of a cooling air-conditioning load and an input in the compressor 31 is transferred in the outdoor heat exchanger 35 to perform the simultaneous cooling and heating operation.

Therefore, when a heat transfer amount in the outdoor heat exchanger 35 may be approximated to zero, the energy saving performance may be improved. To approximate the heat transfer amount in the outdoor heat exchanger 35 to zero, the heat exchange amount in the outdoor heat exchanger 35 may be reduced. To reduce the heat exchange amount in the outdoor heat exchanger 35, the bypass flow control valve 43 may be opened to lower the flow of the refrigerant through the outdoor heat exchanger 35 as described above.

In other words, the refrigerant circuit 1 may approximate the heat exchange amount in the outdoor heat exchanger 35 to zero, and hence the heat transfer amount in the outdoor heat exchanger 35 may be approximated to zero. Therefore, the energy saving performance may be improved.

Note that, during the cooling main operation, an evaporating temperature Te of the indoor heat exchangers 53 in the cooling operation state is set to a fixed value of 0 degrees C., for example. This is because there is possibility of freezing at 0 degrees C. or lower. Moreover, during the cooling main operation, a condensing temperature Tc of the indoor heat exchanger 53 in the heating operation state is set to a fixed value of 50 degrees C., for example.

Figure 10:
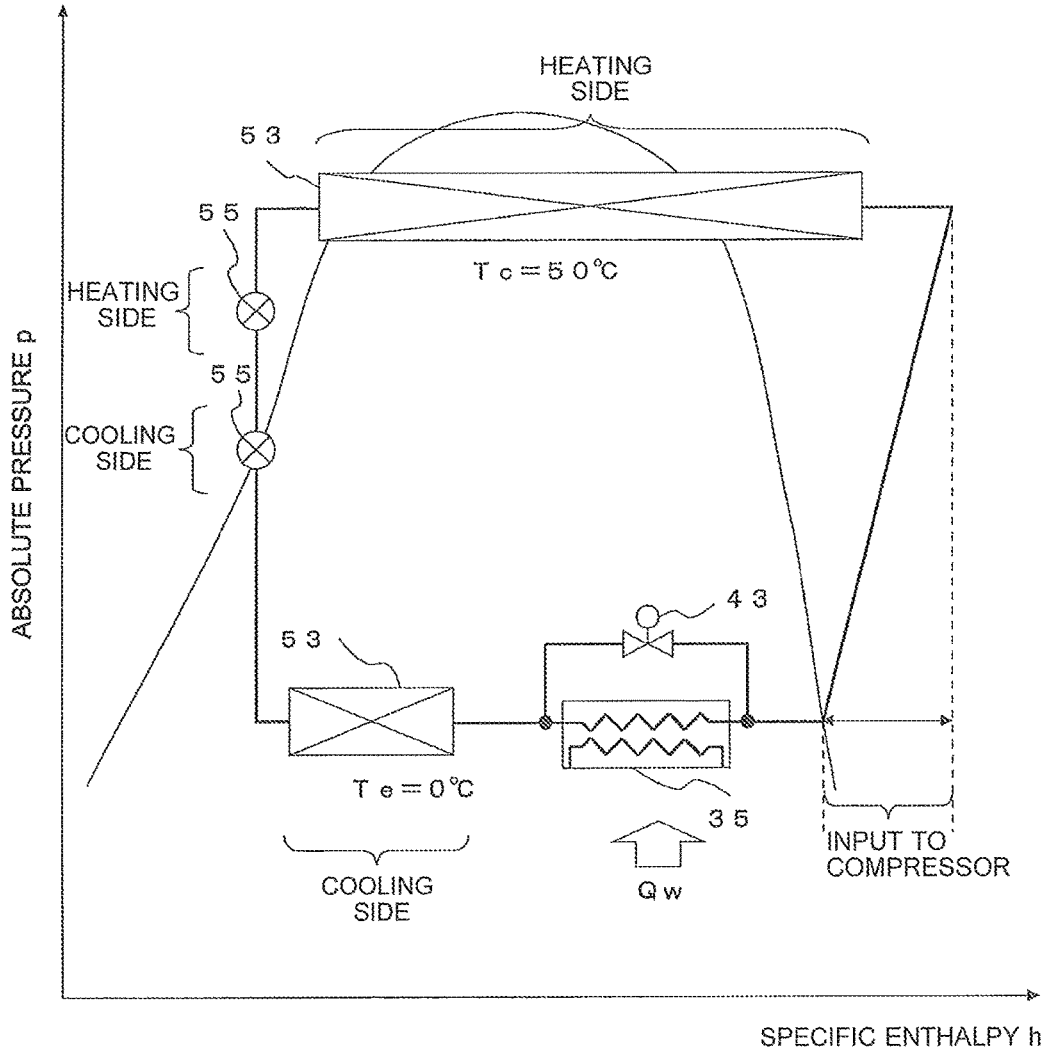
FIG. 10 is an example of a p-h diagram during a heating main operation in Embodiment 1 of the present invention.

FIG. 10 is an example of a p-h diagram during the heating main operation in Embodiment 1 of the present invention. In the heating main operation, the outdoor heat exchanger 35 has the function of an evaporator as described above. Therefore, an amount of heat obtained by subtracting the sum of the cooling air-conditioning load and the input in the compressor 31 from the heating air-conditioning load is removed in the outdoor heat exchanger 35 to perform the simultaneous cooling and heating operation.

Therefore, when a heat removal amount in the outdoor heat exchanger 35 may be approximated to zero, the energy saving performance may be improved. To approximate the heat removal amount in the outdoor heat exchanger 35 to zero, the heat exchange amount in the outdoor heat exchanger 35 may be reduced. To reduce the heat exchange amount in the outdoor heat exchanger 35, the bypass flow control valve 43 may be opened to lower the flow of the refrigerant through the outdoor heat exchanger 35 as described above.

In other words, the refrigerant circuit 1 may approximate the heat exchange amount in the outdoor heat exchanger 35 to zero, and hence the heat removal amount in the outdoor heat exchanger 35 may be approximated to zero. Therefore, the energy saving performance may be improved.

Next, an operation example with the main part and the configuration in Embodiment 1 of the present invention described above as a precondition is described with reference to FIG. 11 to FIG. 14.

Note that, steps describing programs for performing the operations in Embodiment 1 of the present invention include not only processing in which the steps are performed in time sequence in the stated order, but also processing in which the steps are not necessarily processed in time sequence but executed in parallel or individually.

Figure 11:
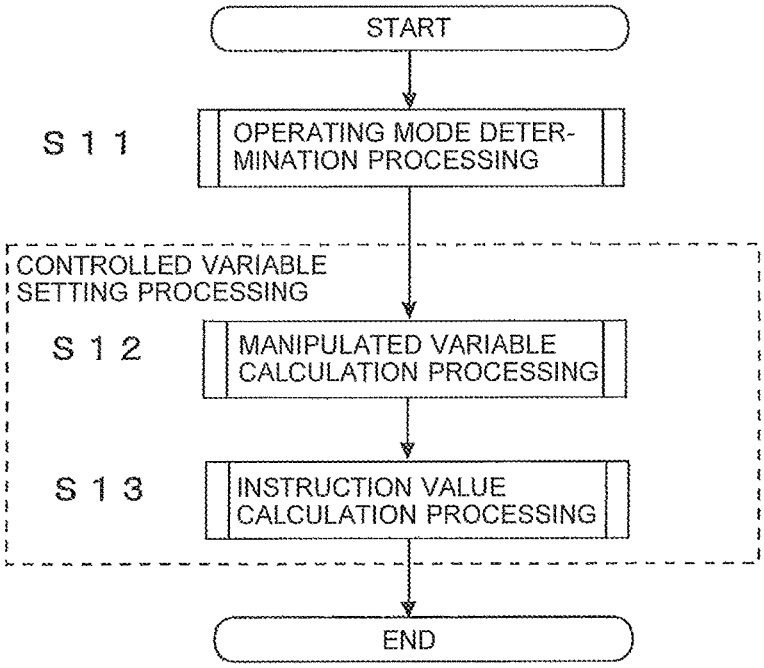
FIG. 11 is a flow chart illustrating an example of control by a controller 13 in Embodiment 1 of the present invention.

FIG. 11 is a flow chart illustrating an example of control by the controller 13 in Embodiment 1 of the present invention. As illustrated in FIG. 11, the processing with which the indoor comfortability and the energy saving performance are improved mainly includes: operating mode determination processing and controlled variable setting processing. Moreover, the controlled variable setting processing mainly includes: manipulated variable calculation processing and instruction value calculation processing.

(Step S11)

The controller 13 executes the operating mode determination processing. Note that, details of the operating mode determination processing are described with reference to FIG. 12.

(Step S12)

After determining the operating mode, the controller 13 executes the manipulated variable calculation processing. Note that, details of the manipulated variable calculation processing are described with reference to FIG. 13.

(Step S13)

After calculating the manipulated variable, the controller 13 executes the instruction value calculation processing and ends the processing. Note that, details of the instruction value calculation processing are described with reference to FIG. 14.

Figure 12:
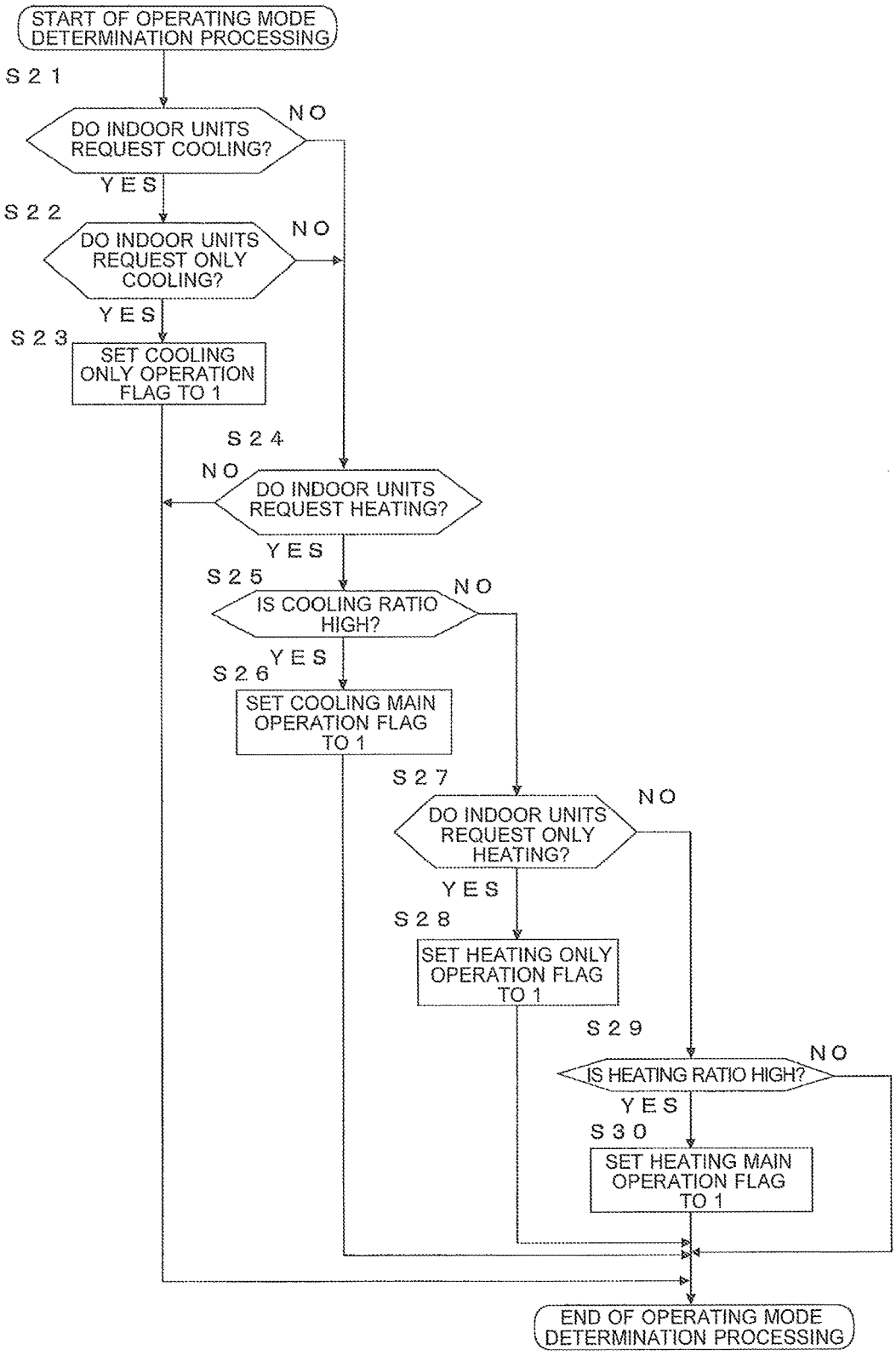
FIG. 12 is a flow chart illustrating details of operating mode determination processing in Embodiment 1 of the present invention.

FIG. 12 is a flow chart illustrating the details of the operating mode determination processing in Embodiment 1 of the present invention.

(Step S21)

The controller 13 determines whether or not the indoor units 12 request cooling. In a case where the indoor units 12 request cooling, the controller 13 proceeds to Step S22. On the other hand, in a case where the indoor units 12 do not request cooling, the controller 13 proceeds to Step S24.

(Step S22)

The controller 13 determines whether or not the indoor units 12 request only cooling. In a case where the indoor units 12 request only cooling, the controller 13 proceeds to Step S23. On the other hand, in a case where the indoor units 12 do not request only cooling, the controller 13 proceeds to Step S24.

(Step S23)

The controller 13 sets a cooling only operation flag to 1 and ends the processing. The state in which the cooling only operation flag is set to 1 herein means that all of the indoor units 12-1 to 12-N are in the cooling operation state.

(Step S24)

The controller 13 determines whether or not the indoor units 12 request heating. In a case where the indoor units 12 request heating, the controller 13 proceeds to Step S25. On the other hand, in a case where the indoor units 12 do not request heating, the controller 13 ends the processing.

(Step S25)

The controller 13 determines whether or not a cooling ratio is high. In a case where the cooling ratio is high, the controller 13 proceeds to Step S26. On the other hand, in a case where the cooling ratio is not high, the controller 13 proceeds to Step S27. The phrase "the cooling ratio is high" as used herein means that, of the indoor units 12-1 to 12-N, the number of indoor units 12 in the cooling operation state is larger than the number of indoor units 12 in the heating operation state.

(Step S26)

The controller 13 sets a cooling main operation flag to 1 and ends the processing. The state in which the cooling main operation flag is set to 1 herein means that the cooling operation and the heating operation are respectively performed in any of the indoor units 12-1 to 12-N, and, of the indoor units 12-1 to 12-N, the number of indoor units 12 in the cooling operation state is larger than the number of indoor units 12 in the heating operation state.

(Step S27)

The controller 13 determines whether or not the indoor units 12 request only heating. In a case where the indoor units 12 request only heating, the controller 13 proceeds to Step S28. On the other hand, in a case where the indoor units 12 do not request only heating, the controller 13 proceeds to Step S29.

(Step S28)

The controller 13 sets a heating only operation flag to 1 and ends the processing. The state in which the heating only operation flag is set to 1 herein means that all of the indoor units 12-1 to 12-N are in the heating operation state.

(Step S29)

The controller 13 determines whether or not a heating ratio is high. In a case where the heating ratio is high, the controller 13 proceeds to Step S30. On the other hand, in a case where the heating ratio is not high, the controller 13 ends the processing.

(Step S30)

The controller 13 sets a heating main operation flag to 1 and ends the processing. The state in which the heating main operation flag is set to 1 herein means that the cooling operation and the heating operation are respectively performed in any of the indoor units 12-1 to 12-N, and, of the indoor units 12-1 to 12-N, the number of indoor units 12 in the heating operation state is larger than the number of indoor units 12 in the cooling operation state.

Note that, the operating mode determination processing described above is merely exemplary, and the present invention is not particularly limited thereto. Moreover, various flags and their setting values described above are merely exemplary, and the present invention is not particularly limited thereto.

Figure 13:
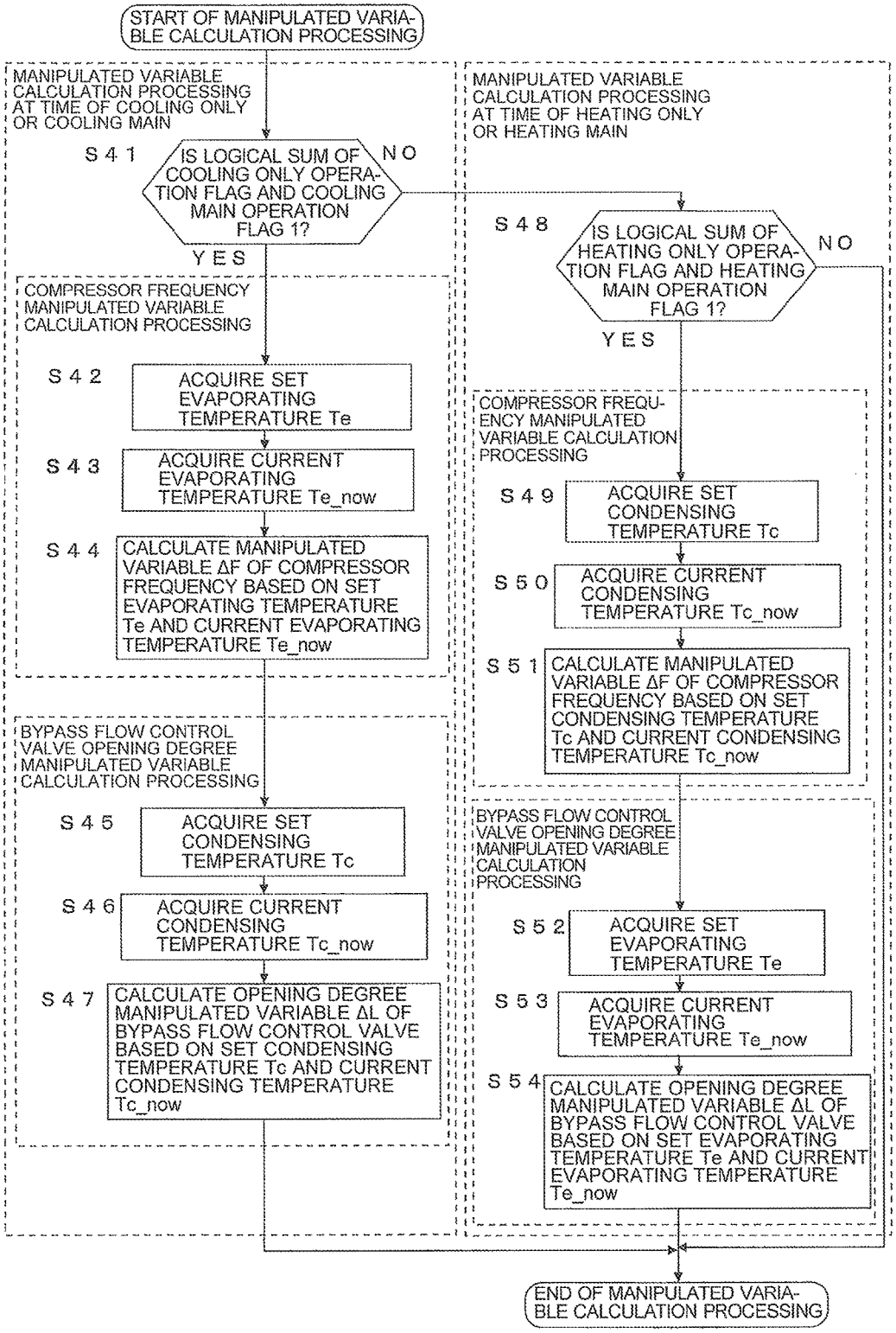
FIG. 13 is a flow chart illustrating details of manipulated variable calculation processing in Embodiment 1 of the present invention.

In the above-mentioned processing, the operating mode is determined. Next, the manipulated variable calculation processing corresponding to each of the determined operating modes is described with reference to FIG. 13. FIG. 13 is a flow chart illustrating the details of the manipulated variable calculation processing in Embodiment 1 of the present invention.

In the manipulated variable calculation processing, different processing is executed for a case where the operating mode is a cooling only operation or the cooling main operation and a case where the operating mode is a heating only operation or the heating main operation. This is because, in the case of the cooling only operation or the cooling main operation, the outdoor heat exchanger 35 is used as the condensor, and in the case of the heating only operation or the heating main operation, the outdoor heat exchanger 35 is used as an evaporator.

In the case where the outdoor heat exchanger 35 is used as the condensor, an opening degree manipulated variable of the bypass flow control valve 43 is calculated based on the condensing temperature Tc of the indoor units 12 in the heating operation state. On the other hand, in the case where the outdoor heat exchanger 35 is used as the evaporator, an opening degree manipulated variable of the bypass flow control valve 43 is calculated based on the evaporating temperature Te of the indoor units 12 in the cooling operation state.

(Step S41)

The controller 13 determines whether or not a logical sum of the cooling only operation flag and the cooling main operation flag is 1. In a case where the logical sum of the cooling only operation flag and the cooling main operation flag is 1, the controller 13 proceeds to Step S42. On the other hand, in a case where the logical sum of the cooling only operation flag and the cooling main operation flag is not 1, the controller 13 proceeds to Step S48.

(Step S42)

The controller 13 acquires the set evaporating temperature Te. The controller 13 acquires, as the evaporating temperature set to correspond to an evaporating temperature of the indoor units 12 in the cooling operation state, for example, Te=0 degrees C.

(Step S43)

The controller 13 acquires a current evaporating temperature Te_now. The controller 13 acquires, for example, the current evaporating temperature Te_now of the indoor units 12 in the cooling operation state.

(Step S44)

The controller 13 calculates, based on the set evaporating temperature Te and the current evaporating temperature Te_now, a manipulated variable ΔF (Hz) of a compressor frequency. More specifically, the controller 13 calculates the manipulated variable ΔF (Hz) of the compressor frequency so that the current evaporating temperature Te_now becomes the set evaporating temperature Te. In other words, the controller 13 determines the manipulated variable ΔF (Hz) of the compressor frequency so that a deviation between the set evaporating temperature Te and the current evaporating temperature Te_now becomes zero.

(Step S45)

The controller 13 acquires the set condensing temperature Tc. The controller 13 acquires, as the condensing temperature set to correspond to a condensing temperature of the indoor units 12 in the heating operation state, for example, Tc=50 degrees C.

(Step S46)

The controller 13 acquires a current condensing temperature Tc_now. The controller 13 acquires, for example, the current condensing temperature Tc_now of the indoor units 12 in the heating operation state.

(Step S47)

The controller 13 calculates, based on the set condensing temperature Tc and the current condensing temperature Tc_now, an opening degree manipulated variable ΔL (pulse) of the bypass flow control valve 43, and ends the processing. More specifically, the controller 13 calculates the opening degree manipulated variable ΔL (pulse) of the bypass flow control valve 43 so that the current condensing temperature Tc_now becomes the set condensing temperature Tc. In other words, the controller 13 determines the opening degree manipulated variable ΔL (pulse) of the bypass flow control valve 43 so that a deviation between the set condensing temperature Tc and the current condensing temperature Tc_now becomes zero.

(Step S48)

The controller 13 determines whether or not a logical sum of the heating only operation flag and the heating main operation flag is 1. In a case where the logical sum of the heating only operation flag and the heating main operation flag is 1, the controller 13 proceeds to Step S49. On the other hand, in a case where the logical sum of the heating only operation flag and the heating main operation flag is not 1, the controller 13 ends the processing.

(Step S49)

The controller 13 acquires the set condensing temperature Tc. The controller 13 acquires, as the condensing temperature set to correspond to a condensing temperature of the indoor units 12 in the heating operation state, for example, Tc=50 degrees C.

(Step S50)

The controller 13 acquires the current condensing temperature Tc_now. The controller 13 acquires, for example, the current condensing temperature Tc_now of the indoor units 12 in the heating operation state.

(Step S51)

The controller 13 calculates, based on the set condensing temperature Tc and the current condensing temperature Tc_now, the manipulated variable ΔF (Hz) of the compressor frequency. More specifically, the controller 13 calculates the manipulated variable ΔF (Hz) of the compressor frequency so that the current condensing temperature Tc_now becomes the set condensing temperature Tc. In other words, the controller 13 determines the manipulated variable ΔF (Hz) of the compressor frequency so that the deviation between the set condensing temperature Tc and the current condensing temperature Tc_now becomes zero.

(Step S52)

The controller 13 acquires the set evaporating temperature Te. The controller 13 acquires, as the evaporating temperature set to correspond to an evaporating temperature of the indoor units 12 in the cooling operation state, for example, Te=0 degrees C.

(Step S53)

The controller 13 acquires the current evaporating temperature Te_now. The controller 13 acquires, for example, the current evaporating temperature Te_now of the indoor units 12 in the cooling operation state.

(Step S54)

The controller 13 calculates, based on the set evaporating temperature Te and the current evaporating temperature Te_now, the opening degree manipulated variable ΔL (pulse) of the bypass flow control valve 43, and ends the processing. More specifically, the controller 13 calculates the opening degree manipulated variable ΔL (pulse) of the bypass flow control valve 43 so that the current evaporating temperature Te_now becomes the set evaporating temperature Te. In other words, the controller 13 determines the opening degree manipulated variable ΔL (pulse) of the bypass flow control valve 43 so that the deviation between the set evaporating temperature Te and the current evaporating temperature Te_now becomes zero.

Note that, the processing of Step S41 to Step S47 corresponds to the manipulated variable calculation processing at the time of cooling only or cooling main, and the processing of Step S42 to Step S44 corresponds to compressor frequency manipulated variable calculation processing. The processing of Step S45 to Step S47 corresponds to bypass flow control valve opening degree manipulated value calculation processing.

Moreover, the processing of Step S48 to Step S54 corresponds to the manipulated variable calculation processing at the time of heating only or heating main, and the processing of Step S49 to Step S51 corresponds to the compressor frequency manipulated variable calculation processing. The processing of Step S52 to Step S54 corresponds to the bypass flow control valve opening degree manipulated value calculation processing.

Note that, in the above description, the processing relating to the evaporating temperature and the processing relating to the condensing temperature have been described for each corresponding indoor unit 12, but in reality, similar processing is repeatedly executed for the number of indoor units concerned. In this case, a plurality of calculation results is obtained, and hence an average value may be determined and set as a representative value, for example. Note that, a method of determining the representative value is not particularly limited.

Figure 14:
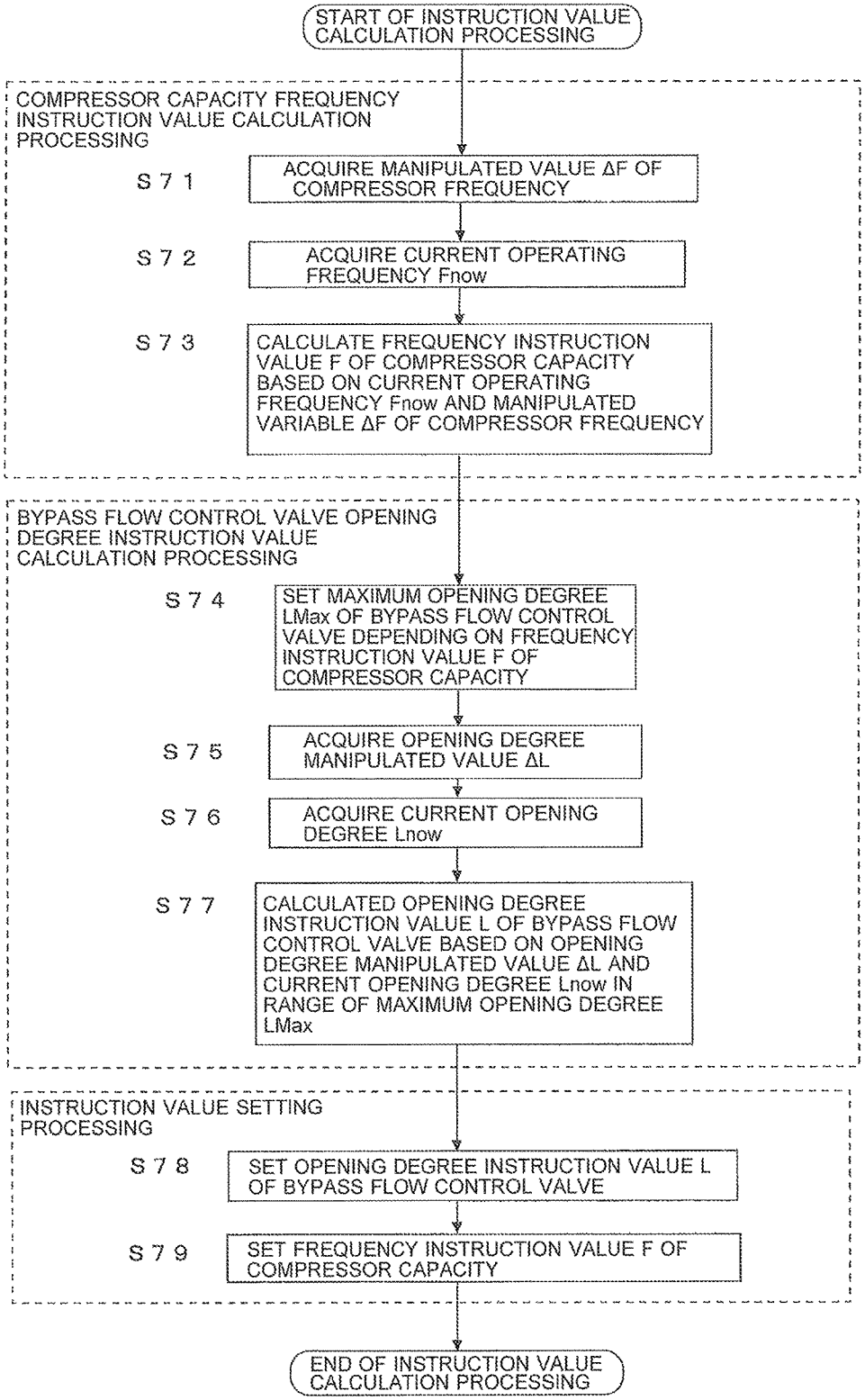
FIG. 14 is a flow chart illustrating details of instruction value calculation processing in Embodiment 1 of the present invention.

Next, based on the manipulated variable ΔF of the compressor frequency and the opening degree manipulated variable ΔL of the bypass flow control valve 43, which have been calculated above, an opening degree instruction value of the bypass flow control valve 43 and a frequency instruction value of a compressor capacity are determined. FIG. 14 is a flow chart illustrating the details of the instruction value calculation processing in Embodiment 1 of the present invention.

(Step S71)

The controller 13 acquires the manipulated variable ΔF of the compressor frequency.

(Step S72)

The controller 13 acquires a current operating frequency Fnow.

(Step S73)

The controller 13 calculates a frequency instruction value F of the compressor capacity based on the current operating frequency Fnow and the manipulated variable ΔF of the compressor frequency. For example, the controller 13 calculates as in the following equation (1).

(Math. 1)

$$F = F\text{now} + \Delta F \tag{1}$$

More specifically, the manipulated variable ΔF of the compressor frequency is added to the current operating frequency Fnow to determine the frequency instruction value F. Note that, ΔF is positive in some cases, and is negative in other cases.

(Step S74)

The controller 13 sets a maximum opening degree LMax of the bypass flow control valve 43 depending on the frequency instruction value F of the compressor capacity. This setting may be determined based on the correlation between the Cv value and the AK value, which are described with reference to FIG. 5, for example.

(Step S75)

The controller 13 acquires the opening degree manipulated variable ΔL.

(Step S76)

The controller 13 acquires a current opening degree Lnow.

(Step S77)

The controller 13 calculates an opening degree instruction value L of the bypass flow control valve 43 based on the opening degree manipulated variable ΔL and the current opening degree Lnow in a range of the maximum opening degree LMax. For example, the controller 13 calculates as in the following equation (2).

(Math. 2)

$$L = L\text{now} + \Delta L \text{ (where, } L \leq L\text{Max)} \tag{2}$$

More specifically, the opening degree manipulated variable ΔL is added to the current opening degree Lnow to determine the opening degree instruction value L. Note that, ΔL is positive in some cases, and is negative in other cases.

(Step S78)

The controller 13 sets the opening degree instruction value L of the bypass flow control valve 43.

(Step S79)

The controller 13 sets the frequency instruction value F of the compressor capacity, and ends the processing.

Note that, the frequency instruction value F is set after the opening degree instruction value L is set.

Note that, the processing of Step S71 to Step S73 corresponds to compressor capacity frequency instruction value calculation processing. Moreover, the processing of Step S74 to Step S77 corresponds to bypass flow control valve opening degree instruction value calculation processing.

Moreover, the processing of Step S78 and Step S79 corresponds to instruction value setting processing.

From the above description, in a case where it is desired to lower the AK value, which is the heat exchange amount in the outdoor heat exchanger 35, that is, the heat conductance as in a full heat recovery operation, the bypass flow control valve 43 may be opened. This is because, in the outdoor heat exchanger 35, the direction in which the refrigerant flows and the direction in which the heat medium flows are formed at opposing positions along the direction of gravity 95. With this structure, the effect of the hydraulic head becomes large, and hence a required maximum Cv value of the bypass flow control valve 43 is decreased.

Moreover, the required maximum Cv value of the bypass flow control valve 43 is decreased, and hence the bypass flow control valve 43 having a small capacity may suffice. Therefore, the bypass flow control valve 43 itself may be downsized as compared to that in the related art, and hence cost reduction may be realized.

Moreover, with the configuration in which, when the bypass flow control valve 43 has the same Cv value as that in the related art, the refrigerant flowing through the outdoor heat exchanger 35 flows facing to the heat medium, a control range on the lower limit side of the AK value, that is, the heat conductance of the outdoor heat exchanger 35 is expanded. Therefore, in the case of the full heat recovery operation during a low capacity operation of the compressor or the simultaneous cooling and heating operation, controllability of the refrigeration cycle is enhanced, and the refrigeration cycle is stabilized. Therefore, comfortability and the energy saving performance that may be provided by the air-conditioning apparatus are improved.

Moreover, the bypass flow control valve 43 is arranged above the inlet side of the refrigerant of the outdoor heat exchanger 35, and hence the hydraulic head becomes large. Therefore, a controllable range of the AK value of the outdoor heat exchanger 35, that is, the heat source apparatus-side heat exchanger, is increased to improve controllability.

Moreover, the upper limit opening degree of the bypass flow control valve 43 is set depending on a compressor operation capacity, and hence a control range in which the AK value becomes zero may be reduced. Therefore, deterioration in controllability that occurs by the bypass flow control valve 43 being excessively opened may be avoided. Therefore, the refrigeration cycle is stabilized, and hence the comfortability and the energy saving performance that may be provided by the air-conditioning apparatus are improved.

Moreover, the opening degree of the bypass flow control valve 43 is controlled before a change in operation capacity of the compressor 31, and hence even in a case where an operating frequency of the compressor 31 is lowered, an excessive increase in high pressure or an increase in discharge temperature accompanying a lowered heat exchanger capacity due to liquid refrigerant clogging in the outdoor heat exchanger 35 may be avoided. Therefore, the refrigeration cycle is stabilized, and hence the comfortability and the energy saving performance provided by the air-conditioning apparatus are improved.

Moreover, a configuration in which the passage of the refrigerant and the passage of the heat medium in the outdoor heat exchanger 35 face each other is adopted, and hence even with an air-cooled heat exchanger, similar effects as those described above are obtained.

As described above, in Embodiment 1 of the present invention, the air-conditioning apparatus is configured, including: the compressor 31 configured to compress and discharge the refrigerant; the outdoor heat exchanger 35 configured to exchange heat between the refrigerant and the heat medium that enters the outdoor heat exchanger 35; the indoor heat exchanger 53 configured to exchange heat between the refrigerant and the surrounding medium of use; the bypass pipe 41 configured to bypass the refrigerant that is to enter the outdoor heat exchanger 35; and the bypass flow control valve 43 arranged on the bypass pipe 41, which is configured to adjust the flow of the refrigerant that is to enter the outdoor heat exchanger 35, in which the outdoor heat exchanger 35 includes the first passage 111 through which the refrigerant flows, and the second passage 112 through which the heat medium flows, and in which the first passage 111 allows the refrigerant to flow upward.

In the above configuration, the air-conditioning apparatus may utilize the bypass flow control valve 43 and the hydraulic head of the outdoor heat exchanger 35 through which each of the refrigerant and the heat medium flows to lower the heat conductance of the outdoor heat exchanger 35 by a necessary amount. Therefore, the air-conditioning apparatus has the effect that the indoor comfortability and the energy saving performance may be improved.

Moreover, a decrease amount of the AK value is increased, and hence a lower limit value of the AK value is lowered. Therefore, the control range of the heat exchange amount of the outdoor heat exchanger 35 is expanded. In general, when the outdoor temperature is low and the low capacity cooling operation is performed, the required AK value is small, and hence the refrigeration cycle hunts and is prone to be destabilized with the effect of outdoor wind, but the controlled lower limit value of the AK value is expanded, and hence the refrigeration cycle is stabilized.

Therefore, the air-conditioning apparatus according to Embodiment 1 of the present invention may improve the indoor comfortability and the energy saving performance.

Moreover, in Embodiment 1 of the present invention, the air-conditioning apparatus in which, in the outdoor heat exchanger 35, the first passage 111 and the second passage 112 face each other is configured.

Therefore, for example, during the heating operation, a pressure loss is improved by the difference in hydraulic head between inside the outdoor heat exchanger 35 and the refrigerant pipe on the outlet side connected to the opening 37*a* of the outdoor heat exchanger 35. Therefore, the pressure loss is reduced, which results in energy saving. Moreover, in the outdoor heat exchanger 35, the refrigerant and the heat medium are allowed to flow in opposite directions in cooling or heating, and hence the heat exchange efficiency becomes high, leading to energy saving.

Moreover, in Embodiment 1 of the present invention, the air-conditioning apparatus in which the opening 37*a* through which the refrigerant enters the outdoor heat exchanger 35 is formed, and in which the bypass flow control valve 43 is arranged above the opening 37*a* is configured.

Therefore, the hydraulic head becomes large, and the controllable range of the AK value of the outdoor heat exchanger 35 is expanded, with the result that the controllability may be improved.

Moreover, in Embodiment 1 of the present invention, the air-conditioning apparatus in which as the operation capacity of the compressor 31 is increased, the upper limit value of the Cv value of the bypass flow control valve 43 is increased is configured.

Therefore, the Cv value in the case of total bypassing is grasped in advance, and hence the controllability of the AK value of the outdoor heat exchanger 35 may be improved.

Moreover, in Embodiment 1 of the present invention, the air-conditioning apparatus in which, during the simultaneous cooling and heating operation, the controller 13 sets the opening degree of the bypass flow control valve 43, and sets the operation capacity of the compressor 31 is configured.

Therefore, the bypass flow control valve 43 is controlled prior to the compressor 31, and hence the lowered heat exchange amount due to the liquid clogging in the outdoor heat exchanger 35 may be avoided, with the result that the refrigeration cycle may be stabilized.

Embodiment 2

Differences from Embodiment 1 are that a bridge circuit formed of a plurality of check valves 71*a* to 71*d* is further included between the compressor 31 and the plurality of indoor units 12, and that the outdoor heat exchanger 35 is arranged at an intermediate point of the bridge circuit so that the refrigerant flows in the same direction during cooling and during heating. Note that, in Embodiment 2 of the present invention, items that are not specifically described are similar to those in Embodiment 1, and the same functions and components are denoted by the same reference signs.

Figure 15:
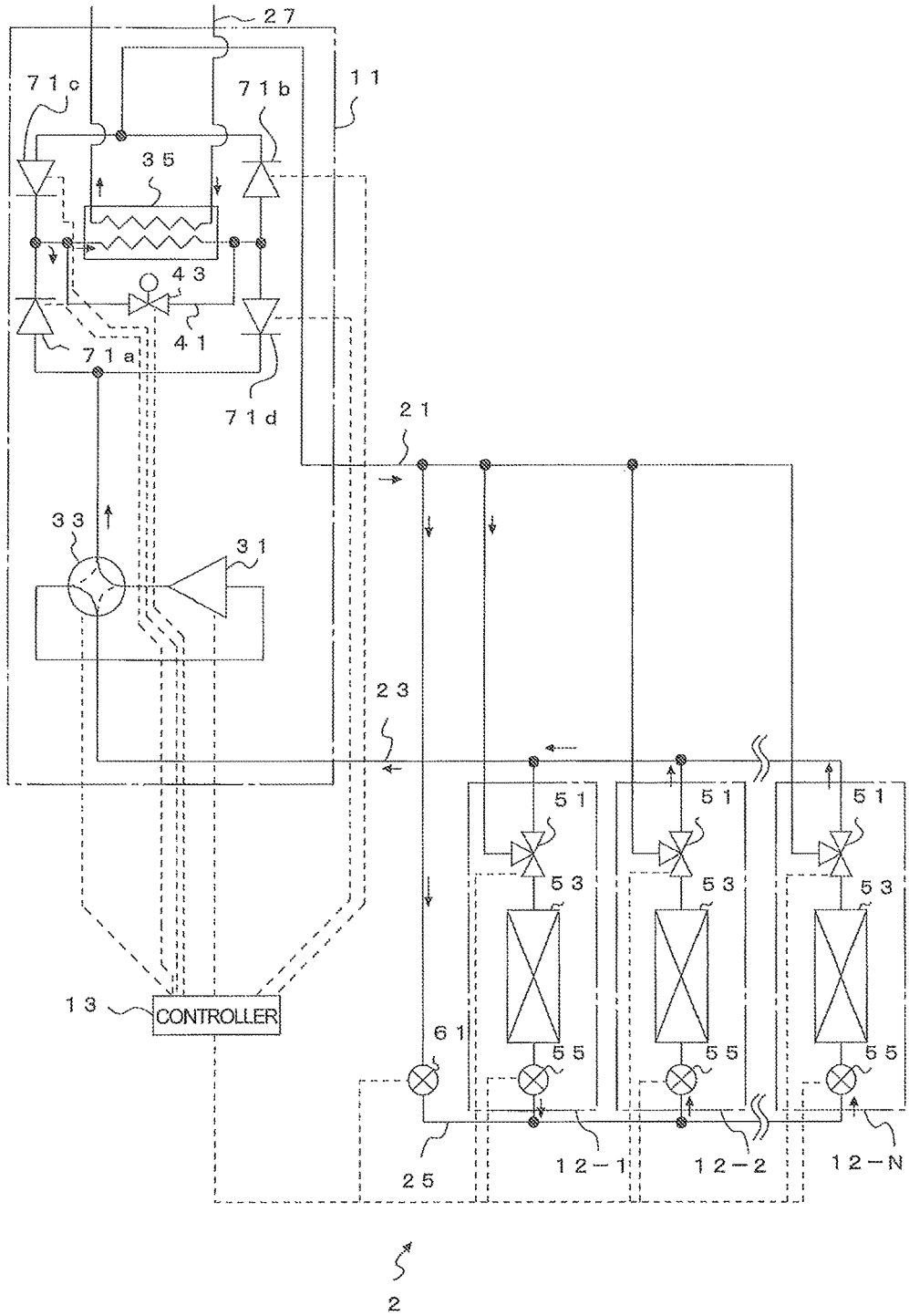
FIG. 15 is a diagram illustrating an example of a refrigerant circuit 2 of an air-conditioning apparatus according to Embodiment 2 of the present invention.
Figure 16:
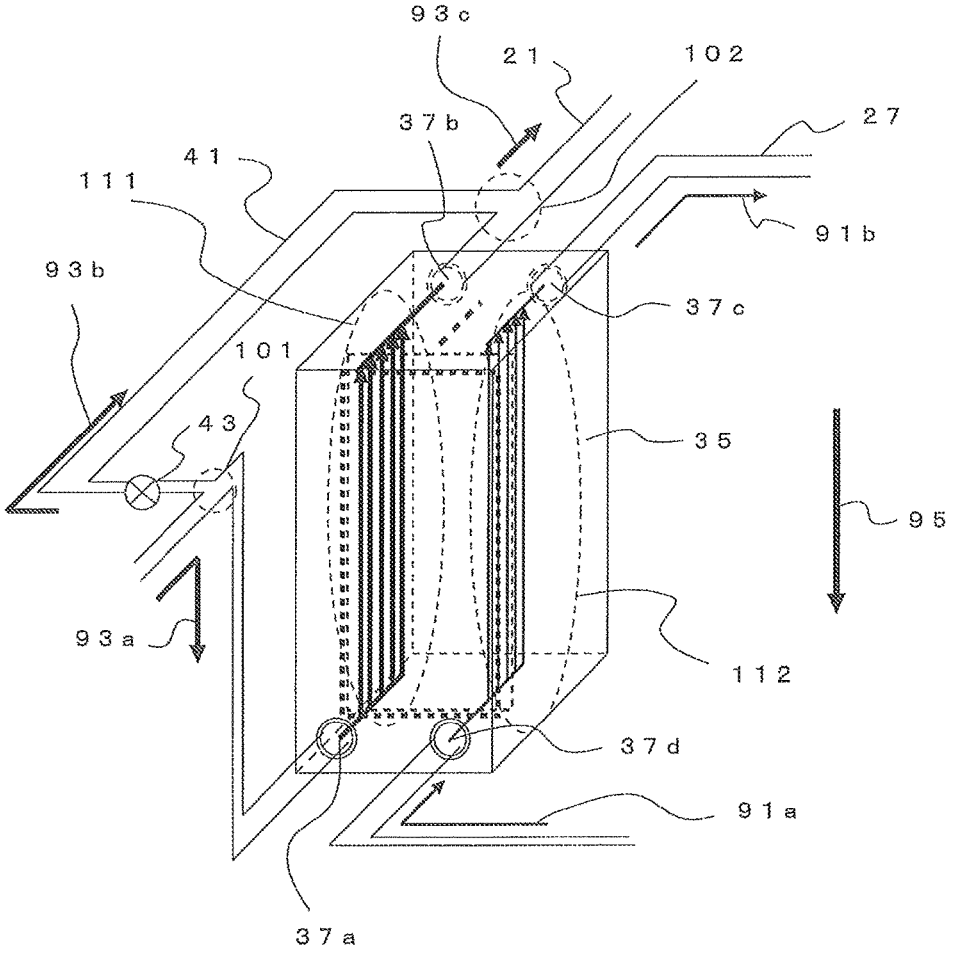
FIG. 16 is a diagram illustrating an example of a schematic configuration of an outdoor heat exchanger 35 according to Embodiment 2 of the present invention.

FIG. 15 is a diagram illustrating an example of a refrigerant circuit 2 of an air-conditioning apparatus according to Embodiment 2 of the present invention. FIG. 16 is a diagram illustrating an example of a schematic configuration of an outdoor heat exchanger 35 according to Embodiment 2 of the present invention.

As illustrated in FIG. 15, the refrigerant circuit 2 includes the bridge circuit formed of the plurality of check valves 71*a* to 71*d* between the compressor 31 and the plurality of indoor units 12. The outdoor heat exchanger 35 is arranged at the intermediate point of the bridge circuit. Then, in the case of the heating operation or the heating main operation in which the ratio of the cooling operation is low, the check valves 71*a* to 71*d* allow the refrigerant to flow through the first passage 111 in the same direction. In other words, in the case where any one of the indoor heat exchangers 53 functions as a condensor, as illustrated in FIG. 16, the two-phase refrigerant that enters the outdoor heat exchanger 35 is allowed to flow upward.

With this configuration, during the heating operation, in the outdoor heat exchanger 35, of the two-phase refrigerant that enters, liquid refrigerant that contributes to evaporation of the refrigerant may be held on a lower side. Therefore, evaporation latent heat may be utilized effectively, with the result that heat transfer performance is improved, and the energy saving performance is improved.

Moreover, a pressure difference ΔPw1 resulting from the hydraulic head from the first furcation 101 to the opening 37*a*, and a pressure difference ΔPw2 resulting from the hydraulic head from the opening 37*a* to the opening 37*b* hold a relationship in the following equation (3) based on a relationship of (refrigerant density at evaporator inlet ρ1)> (average refrigerant density in evaporator ρ2).

(Math. 3)

$$\Delta Pw1 > \Delta Pw2 \quad (3)$$

Therefore, the pressure loss in the outdoor heat exchanger 35 is reduced by the difference in hydraulic head, leading to energy saving.

Moreover, in the outdoor heat exchanger 35, in both cases of cooling and heating, the refrigerant and a fluid with which heat is to be exchanged are allowed to flow in the opposite directions, and hence a temperature difference is decreased with the establishment of Lorentz cycle, leading to high heat exchange efficiency and energy saving.

In the above description, in Embodiment 2 of the present invention, the air-conditioning apparatus further including the bridge circuit formed of the plurality of check valves 71 between the compressor 31 and the plurality of indoor heat exchangers 53, in which the outdoor heat exchanger 35 is arranged at the intermediate point of the bridge circuit, and in which, in the case where any one of the plurality of indoor heat exchangers 53 functions as the condensor, the bridge circuit changes the flowing direction of the refrigerant flowing through the first passage 111 upward.

In the above configuration, during the heating operation, in the outdoor heat exchanger 35, of the two-phase refrigerant that enters, the liquid refrigerant that contributes to the evaporation of the refrigerant may be held on the lower side. Therefore, the evaporation latent heat may be utilized effectively, with the result that the heat transfer performance is improved, and the energy saving performance is improved.

Embodiment 3

A difference from Embodiments 1 and 2 is that, as the heights of the passage of the refrigerant and the passage of the cooling water, which are formed in an outdoor heat exchanger 36, increase, passage cross-sectional areas of the first passage and the second passage increase in the outdoor heat exchanger 36. Note that, in Embodiment 3 of the present invention, items that are not specifically described are similar to those in Embodiments 1 and 2, and the same functions and components are denoted by the same reference signs.

Figure 17:
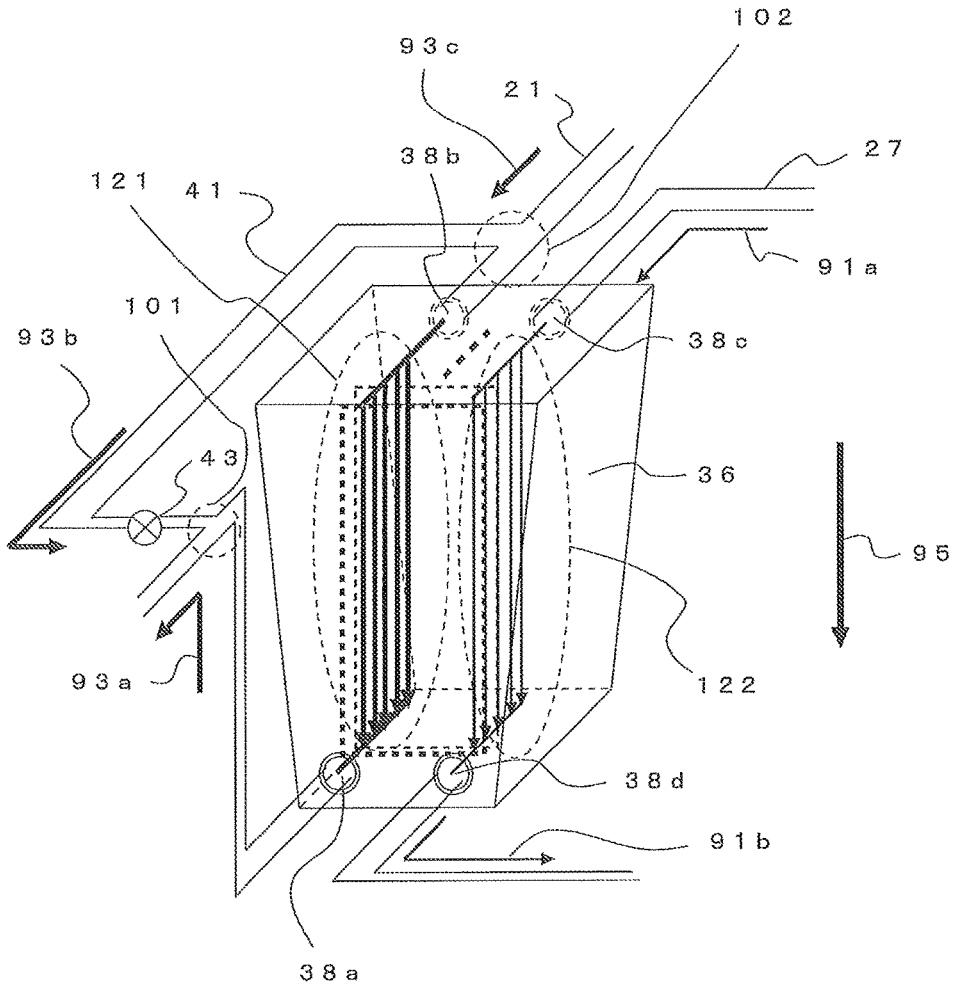
FIG. 17 is a diagram illustrating an example of a schematic configuration of an outdoor heat exchanger 36 according to Embodiment 3 of the present invention.
Figure 18:
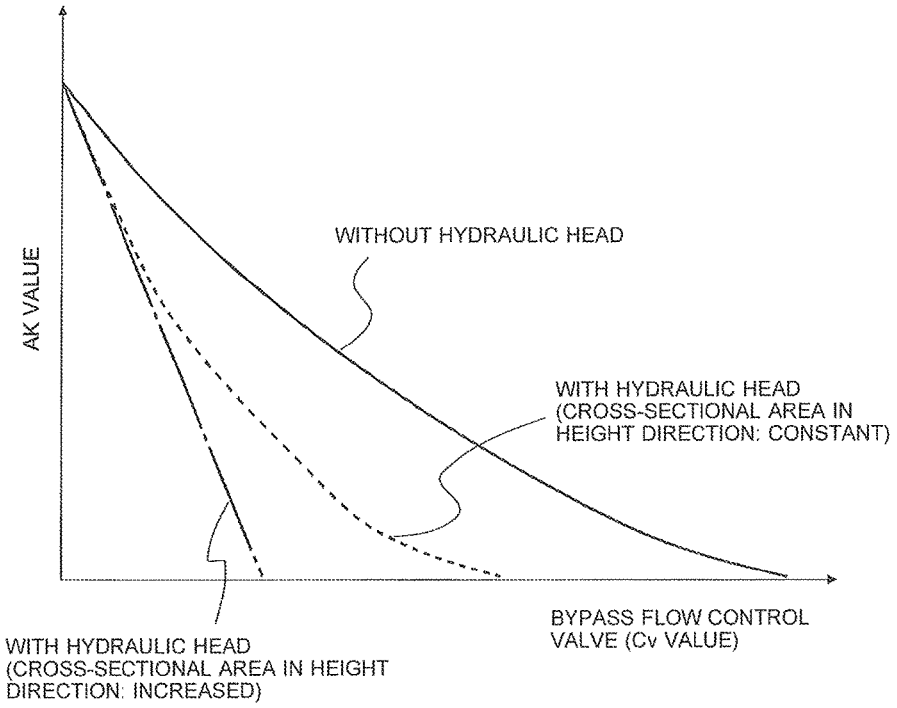
FIG. 18 is a graph showing an example of a correlation between a Cv value of a bypass flow control valve 43 and an AK value in a case where a compressor operation capacity is a fixed value in Embodiment 3 of the present invention.

FIG. 17 is a diagram illustrating an example of a schematic configuration of the outdoor heat exchanger 36 according to Embodiment 3 of the present invention. FIG. 18 is a graph showing an example of a correlation between the Cv value of the bypass flow control valve 43 and the AK value in a case where the compressor operation capacity is a fixed value in Embodiment 3 of the present invention.

As illustrated in FIG. 17, as heights of a first passage 121 and a second passage 122 increase, the outdoor heat exchanger 36 is formed to have the passage cross-sectional areas increased.

In this configuration, in the case where the opening degree of the bypass flow control valve 43 is opened to increase the bypass flow, a liquid phase ratio in the first passage 121 of the outdoor heat exchanger 36 is increased. Then, in the case where the outdoor heat exchanger 36 is the condensor, that is, in the case where the heating operation is being performed, in the outdoor heat exchanger 36, as illustrated in FIG. 17, from an opening 38*b* toward an opening 38*a*, a liquid phase portion is formed from a downstream side of the flow of the refrigerant. In other words, the liquid phase portion is formed from an upper side toward the lower side of the first passage 121 of the outdoor heat exchanger 36.

Therefore, in the configuration described above, in the case where the heating operation is being performed, as the cross-sectional area on an upstream side of the first passage 121 of the outdoor heat exchanger 35 is smaller, an increase rate of the hydraulic head accompanying an increase in liquid phase ratio in the outdoor heat exchanger 36 becomes higher.

Therefore, with the adoption of a passage configuration of the outdoor heat exchanger 36 in which as the liquid phase ratio becomes higher, the hydraulic head becomes higher, a required Cv value of the bypass flow control valve 43 becomes smaller, with the result that the bypass flow control valve 43 may be downsized, leading to space saving and cost reduction.

An adjustment of a rate of change of the cross-sectional area in the passage direction of the outdoor heat exchanger 36 has changed a relationship of the Cv value, which is the opening degree change amount of the bypass flow control valve 43, and the AK value to a linear relationship. Therefore, as shown in FIG. 18, an amount of change of the Cv value of the bypass flow control valve 43, which corresponds to the AK value, may be calculated with a proportional expression, and hence a control gain becomes constant, which facilitates control design.

Note that, in the above description, the example in which, in the case where the heating operation is performed, the increase rate of the hydraulic head accompanying the increase in liquid phase ratio of the outdoor heat exchanger 36 has been increased to change the relationship of the Cv value, which is the opening degree change amount of the bypass flow control valve 43, and the AK value to the linear relationship has been described, but the present invention is not particularly limited thereto. For example, to obtain similar effects in the case where the cooling operation is performed, a configuration in which, as the heights of the first passage 121 and the second passage 122 increase, the outdoor heat exchanger 36 has the passage cross-sectional areas formed to be reduced may be adopted.

Moreover, a configuration in which the passage cross-sectional areas of the outdoor heat exchanger 36 may be varied may be adopted to adopt a configuration in which, during the cooling operation or the heating operation, the passage cross-sectional areas are changed to correspond to the operation. In that case, for example, a configuration in which a plurality of gates are provided to the first passage 121, and the gates are opened and closed as appropriate to vary the passage cross-sectional areas may be adopted. Note that, the configuration of the passage cross-sectional areas described above is merely exemplary, and the present invention is not particularly limited thereto.

In the above description, in Embodiment 3 of the present invention, an air-conditioning apparatus in which, as the heights of the first passage 121 and the second passage 122 increase, the outdoor heat exchanger 36 has the passage cross-sectional areas formed to be increased is configured.

In the above-mentioned configuration, the passage configuration of the outdoor heat exchanger 36 in which, as the liquid phase ratio becomes higher, the hydraulic head becomes higher is adopted, and hence the required Cv value of the bypass flow control valve 43 becomes smaller, with the result that the bypass flow control valve 43 may be downsized, leading to space saving and cost reduction.

Note that, Embodiments 1 to 3 of the present invention may be performed individually or in combination. In any case, the advantageous effects described above may be obtained.

The invention claimed is:

1. An air-conditioning apparatus, comprising:

a compressor for compressing and discharging a refrigerant;

a heat source apparatus-side heat exchanger for exchanging heat between the refrigerant and a heat medium that enters the heat source apparatus-side heat exchanger;

a use-side heat exchanger for exchanging heat between the refrigerant and a surrounding medium of use;

a bypass pipe for bypassing the refrigerant that is to enter the heat source apparatus-side heat exchanger, the bypass pipe having a first end and a second end, the first end of the bypass pipe being connected to an inlet side of the heat source apparatus-side heat exchanger, the second end of the bypass pipe being connected to an outlet side of the heat source apparatus-side heat exchanger;

a bypass flow control valve arranged on the bypass pipe and connected in parallel to the heat source apparatus-side heat exchanger, the bypass flow control valve being configured to, by adjusting the flow of the refrigerant through the bypass pipe, adjust a flow of the refrigerant that is to enter the heat source apparatus-side heat exchanger; and a controller configured to regulate a Cv value of the bypass flow control valve in response to an evaporating temperature or a condensing temperature in the air-conditioning apparatus such that the Cv value of the bypass flow control valve is equal to or less than an upper limit value of the Cv value of the bypass flow control valve, the Cv value of the bypass flow control valve corresponding to an opening degree of the bypass flow control valve, the upper limit of the Cv value of the bypass flow control valve corresponding to a state that a heat exchange amount in the heat source apparatus-side heat exchanger is zero, wherein the heat source apparatus-side heat exchanger includes a first passage through which the refrigerant flows, a second passage through which the heat medium flows, and a refrigerant inflow opening through which the refrigerant enters the heat source apparatus-side heat exchanger, wherein the first passage allows the refrigerant to flow upward, wherein the bypass flow control valve is arranged above the refrigerant inflow opening, and wherein the controller is configured to increase the upper limit value of the Cv value of the bypass flow control valve in response to an increased operation capacity of the compressor.

2. The air-conditioning apparatus of claim 1, wherein, in the heat source apparatus-side heat exchanger, the refrigerant flows through the first passage and the heat medium flows through the second passage in an opposite direction.

3. The air-conditioning apparatus of claim 1, further comprising a plurality of use-side heat exchangers by arranging the plurality of the use-side heat exchangers, wherein the controller switches a part of the plurality of use-side heat exchangers to a cooling operation and another part of the plurality of use-side heat exchangers to a heating operation so that a simultaneous cooling and heating operation in which the cooling operation and the heating operation are executed simultaneously is performed.

4. The air-conditioning apparatus of claim 3, wherein, during the simultaneous cooling and heating operation, the controller sets the opening degree of the bypass flow control valve, and sets the operation capacity of the compressor.

5. The air-conditioning apparatus of claim 3, further comprising a bridge circuit formed of a plurality of check valves between the compressor and the plurality of use-side heat exchangers, wherein the heat source apparatus-side heat exchanger is arranged at an intermediate point of the bridge circuit, and wherein, in a case where any one of the plurality of use-side heat exchangers functions as a condenser, the bridge circuit changes a flowing direction of the refrigerant flowing through the first passage upward.

6. The air-conditioning apparatus of claim 1, wherein, in the heat source apparatus-side heat exchanger, passage cross-sectional areas of the first passage and the second passage increase as heights of the first passage and the second passage increase.

7. The air-conditioning apparatus of claim 3, further comprising a bridge circuit, the bridge circuit including:

a first check valve located between the use side heat exchanger and the inlet side of the heat source apparatus-side heat exchanger, an output side of the first check valve being connected to the inlet side of the heat source apparatus-side heat exchanger;

a second check valve located between the use side heat exchanger and the outlet side of the heat source apparatus-side heat exchanger, an input side of the second check valve being connected to the outlet side of the heat source apparatus-side heat exchanger;

a third check valve located between the use side heat exchanger and the inlet side of the heat source apparatus-side heat exchanger, an output side of the third check valve being connected to the inlet side of the heat source apparatus-side heat exchanger; and a fourth check valve located between the use side heat exchanger and the outlet side of the heat source apparatus-side heat exchanger, an input side of the fourth check valve being connected to the outlet side of the heat source apparatus-side heat exchanger, wherein an input side of the first check valve is connected to an output side of the fourth check valve, and an output side of the second check valve is connected to an input side of the third check valve.

8. The air-conditioning apparatus of claim 3, further comprising:

a first connecting pipe connected to the outlet side of the heat source apparatus-side heat exchanger, and configured to carry the refrigerant from the heat source apparatus-side heat exchanger; and a second connecting pipe connected to the inlet side of the heat source apparatus-side heat exchanger, and configured to carry the refrigerant to the heat source apparatus-side heat exchanger, wherein, the first end of the bypass pipe is connected to the second connecting pipe where the second connecting pipe meets the inlet side of the heat source apparatus-side heat exchanger, the second end of the bypass pipe is connected to the first connecting pipe where the first connecting pipe meets the outlet side of the heat source apparatus-side heat exchanger, and the bypass flow control valve is arranged on the bypass pipe between the first and second connecting pipes, in a location apart from the first connecting pipe and apart from the second connecting pipe.

* * * * *